US012653307B2

(12) United States Patent
Porter

(10) Patent No.: US 12,653,307 B2
(45) Date of Patent: Jun. 16, 2026

(54) MODULAR OUTDOOR KITCHEN COMPONENTS AND METHODS OF PROVIDING MODULAR OUTDOOR KITCHEN COMPONENTS

(71) Applicant: Sebastian Porter, Calgary (CA)

(72) Inventor: Sebastian Porter, Calgary (CA)

(73) Assignee: Sebastian Porter, Calgary (CA)

( * ) Notice: Subject to any disclaimer, the term of this patent is extended or adjusted under 35 U.S.C. 154(b) by 172 days.

(21) Appl. No.: 18/587,129

(22) Filed: Feb. 26, 2024

(65) Prior Publication Data

US 2024/0285074 A1 Aug. 29, 2024

Related U.S. Application Data

(60) Provisional application No. 63/448,120, filed on Feb. 24, 2023.

(51) Int. Cl.

| | |
|---|---|
| ***A47B 77/02*** | (2006.01) |
| ***A47B 55/04*** | (2006.01) |
| ***A47B 77/06*** | (2006.01) |

(52) U.S. Cl.

CPC ..... *A47B 77/02* (2013.01); *A47B 55/04* (2013.01); *A47B 77/06* (2013.01)

(58) Field of Classification Search

CPC ..... A47B 77/00; A47B 77/02; A47B 77/04; A47B 77/06; A47B 77/10; A47B 77/14; A47B 77/18; A47B 55/04

See application file for complete search history.

(56) References Cited

U.S. PATENT DOCUMENTS

| | | | | |
|---|---|---|---|---|
| 2,511,584 | A * | 6/1950 | Hill | E04G 11/10 249/34 |
| 3,476,351 | A * | 11/1969 | Burdett | E04G 15/065 249/82 |
| 8,147,009 | B1 * | 4/2012 | Rider | A47B 47/00 52/282.1 |
| 8,511,293 | B2 | 8/2013 | Thompson et al. | |
| 9,661,922 | B2 | 5/2017 | Ehmke et al. | |
| 10,253,511 | B2 * | 4/2019 | Sollars | B28B 7/241 |
| 10,588,459 | B2 * | 3/2020 | Browning | A47J 37/0786 |

(Continued)

FOREIGN PATENT DOCUMENTS

| | | | | |
|---|---|---|---|---|
| CA | 2771418 | A1 * | 9/2013 | A47B 77/02 |
| DE | 177273 | C * | 11/1906 | F25D 3/04 |

(Continued)

*Primary Examiner* — Andrew Roersma
(74) *Attorney, Agent, or Firm* — Smart & Biggar LP

(57) ABSTRACT

Modular outdoor kitchen components and methods of providing modular outdoor kitchen components are described herein. The modular outdoor kitchen components include a monolithic base having: a first end; a second end opposed to the first end, the second end being configured to receive a top member thereon; and at least four walls extending between the first end and the second end. Each of the at least four walls have an interior face and an exterior face. The interior faces co-operate to define an interior cavity of the monolithic base. At least one wall of the at least four walls have an opening therein, the opening being configured to receive a first insertable component. The first insertable component extends inwardly from the opening into the cavity of the monolithic base.

20 Claims, 16 Drawing Sheets

(56) References Cited

U.S. PATENT DOCUMENTS

| | | | | |
|---|---|---|---|---|
| 2004/0065313 | A1* | 4/2004 | Thompson | A47B 81/00 126/37 R |
| 2005/0246969 | A1 | 11/2005 | Jarski | |
| 2008/0163564 | A1* | 7/2008 | Jarski | A47B 43/00 52/79.5 |
| 2008/0163862 | A1* | 7/2008 | Cartwright | A47B 55/00 29/458 |
| 2009/0007501 | A1* | 1/2009 | Belyan | A47B 77/00 52/741.1 |
| 2009/0049762 | A1* | 2/2009 | Termohlen | E04G 11/22 52/79.14 |
| 2010/0148641 | A1 | 6/2010 | Ehmke | |
| 2012/0153782 | A1 | 6/2012 | Fraser | |
| 2013/0113343 | A1* | 5/2013 | Singlak | A47B 77/00 29/525.13 |
| 2015/0017377 | A1 | 1/2015 | Graham et al. | |
| 2015/0027350 | A1* | 1/2015 | Castillo | A47B 37/04 108/50.11 |
| 2017/0127880 | A1* | 5/2017 | Paulding | A47J 37/0759 |
| 2023/0248142 | A1* | 8/2023 | Lunt | E04C 2/04 312/100 |

FOREIGN PATENT DOCUMENTS

| | | | | |
|---|---|---|---|---|
| DE | 20309500 | U1 * | 5/2004 | A01K 31/14 |
| DE | 202013008601 | U1 * | 12/2013 | A47B 55/04 |
| DE | 102018002674 | A1 * | 10/2019 | A47B 55/04 |
| WO | WO-2019023134 | A1 * | 1/2019 | |

* cited by examiner

MODULAR OUTDOOR KITCHEN COMPONENTS AND METHODS OF PROVIDING MODULAR OUTDOOR KITCHEN COMPONENTS

CROSS-REFERENCE TO RELATED APPLICATION

This application claims the benefit of U.S. Provisional Patent Application No. 63/448,120, filed Feb. 24, 2023, and the entire content of U.S. Provisional Patent Application No. 63/448,120 is hereby incorporated by reference.

TECHNICAL FIELD

This disclosure relates generally to outdoor food preparation equipment, and more specifically, to a modular outdoor kitchen components for outdoor patios, terraces, and the like, and methods of providing modular outdoor kitchen components.

BACKGROUND

Increasingly, people are spending more time outside, and this time often includes outdoor cooking. Unfortunately, pre-existing cooking equipment is commonly not effective for many other tasks of food preparation or for the storage of foods, utensils, and cooking supplies. For example, it's often necessary to prepare food indoors before cooking the food outdoors. Additionally, some food requires being maintained at refrigerated temperatures before cooking. Such foods typically must be stored in an indoor refrigerator or a cooler.

Portable outdoor grills for cooking are well known, but lack the aforementioned cooking equipment that is effective for preparing foods for cooking. Permanently constructed barbeque pits and ovens are also known, as are permanent outdoor countertops and cabinets. These outdoor kitchens may include food preparation surfaces, gas burners and associated cooking surfaces, refrigerators for cold food storage, drawers and cabinets for the storage of utensils and other articles, and the like. Unfortunately, such permanently constructed outdoor kitchens are expensive and difficult and time-consuming to construct. In addition, it is impractical to move or alter a permanently constructed outdoor kitchens to suit changing needs or preferences.

Therefore, there is a need for outdoor kitchen components that are less costly and more practical than permanently constructed outdoor kitchens, portable, and/or able to be rearranged or reconfigured to suit changing needs or preferences.

SUMMARY

In accordance with a broad aspect, a modular outdoor kitchen component is described herein. The modular outdoor kitchen component includes a monolithic base having: a first end; a second end opposed to the first end and configured to receive a top member; and at least four walls extending between the first end and the second end. Each of the at least four walls has an interior face and an exterior face. The interior faces co-operating to define an interior cavity of the monolithic base. At least one wall of the at least four walls has an opening therein. The opening is configured to receive a first insertable component. The first insertable component extends inwardly from the opening into the cavity of the monolithic base.

In at least one embodiment, the insertable component is a refrigerator, a cabinet, a set of one or more drawers, a basin, or a sink.

In at least one embodiment, the insertable component is a storage compartment.

In at least one embodiment, one or more of the exterior faces of the monolithic base is configured to resemble brick, stone, stucco, tile, or wood or to otherwise have a pattern thereon.

In at least one embodiment, the second end of the monolithic base is configured to receive one or more wheels.

In at least one embodiment, the modular outdoor kitchen component further includes a second opening in another one of the at least four walls of the monolithic base, the second opening being opposed to the first opening to receive and support a portion of the first insertable component when the first insertable component is extending inwardly from the opening into the cavity of the monolithic base.

In at least one embodiment, the modular outdoor kitchen component further includes a recessed portion in another one of the at least four walls of the monolithic base, the recessed portion being opposed to the first opening to receive and support a portion of the first insertable component when the first insertable component is extending inwardly from the opening into the cavity of the monolithic base.

In at least one embodiment, the recessed portion is shaped to conform to a shape of the insertable component.

In at least one embodiment, the monolithic base is made of concrete.

In at least one embodiment, the modular outdoor kitchen component further includes the insertable component, the insertable component configured to rest on a lower edge of the opening when the insertable component is extending inwardly from the opening into the cavity of the monolithic base.

In accordance with another broad aspect, a method of providing a modular outdoor kitchen component is described herein. The method includes positioning an outer frame on a lower support member of a form, the outer frame comprising a plurality of outer wall members removably coupled together. The method also includes positioning an inner frame on the lower support member of the form to form a cavity between an outer surface of the inner frame and an inner surface of the outer frame, the inner frame comprising a plurality of inner wall members removably coupled together. The method also includes providing a monolithic base by inserting a material into the cavity and allowing the material to harden, removing the outer wall members of the outer frame from the monolithic base, removing the inner wall members of the inner frame from the monolithic base, and inserting an insertable component into an opening formed in a wall of the monolithic base.

In at least one embodiment, at least one of the inner wall members of the inner frame includes a first protruding portion, the first protruding portion extending inwardly from the outer surface of the at least one inner wall member a distance equal to a width of the cavity between an outer surface of the inner frame and an inner surface of the outer frame to form the opening.

In at least one embodiment, at least one other inner wall member of the inner wall members includes a second protruding portion, the second protruding portion extending inwardly from the outer surface of the at least one other inner wall member a distance less than the width of the cavity between an outer surface of the inner frame and an inner surface of the outer frame to form a recessed portion of the monolithic base, the recessed portion being opposed to the opening.

In at least one embodiment the method also includes, before positioning the outer frame on the lower support member of the form, providing the lower support member of the form, the lower support member having a protruding portion sized and shaped to guide the positioning of the inner frame on the lower support member.

In at least one embodiment the method also includes, before positioning the outer frame on the lower support member of the form, providing the lower support member of the form, the lower support member having a plurality of female member of coupling members extending upwardly therefrom, each female member of the coupling members being positioned within the cavity between the outer surface of the inner frame and the inner surface of the outer frame.

In at least one embodiment, before providing the lower support member of the form, the method also includes attaching each female member to the lower support member of the form.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1A:
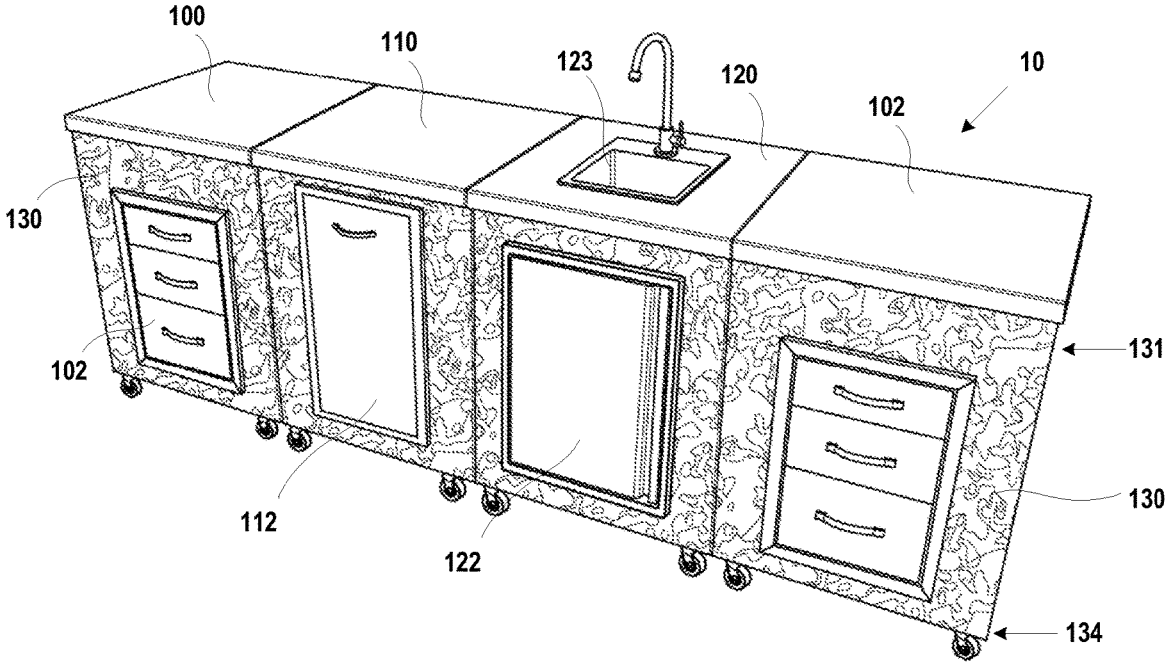
FIG. 1A is a front perspective view of an outdoor kitchen including a set of four outdoor kitchen modular components, according to at least one embodiment described herein.

Further aspects and features of the example embodiments described herein will appear from the following description taken together with the accompanying drawings.

DETAILED DESCRIPTION

Various apparatuses, methods and compositions are described below to provide an example of at least one embodiment of the claimed subject matter. No embodiment described below limits any claimed subject matter and any claimed subject matter may cover apparatuses and methods that differ from those described below. The claimed subject matter are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed subject matter. Any subject matter that is disclosed in an apparatus, method or composition described herein that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the end result is not significantly changed. These terms of degree should be construed as including a deviation of the modified term, such as 1%, 2%, 5%, or 10%, for example, if this deviation does not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

It should also be noted that, as used herein, the wording "and/or" is intended to represent an inclusive—or. That is, "X and/or Y" is intended to mean X, Y or X and Y, for example. As a further example, "X, Y, and/or Z" is intended to mean X or Y or Z or any combination thereof. Also, the expression of A, B and C means various combinations including A; B; C; A and B; A and C; B and C; or A, B and C.

The following description is not intended to limit or define any claimed or as yet unclaimed subject matter. Subject matter that may be claimed may reside in any combination or sub-combination of the elements or process steps disclosed in any part of this document including its claims and figures. Accordingly, it will be appreciated by a person skilled in the art that an apparatus, system or method disclosed in accordance with the teachings herein may embody any one or more of the features contained herein and that the features may be used in any particular combination or sub-combination that is physically feasible and realizable for its intended purpose.

Recently, there has been a growing interest in developing new outdoor kitchen components that are less costly and more practical than permanently constructed outdoor kitchens, portable, and/or able to be rearranged or reconfigured to suit changing needs or preferences.

Herein, the term "monolithic" means formed of a single material and/or that the component being referred to as "monolithic" is intractably indivisible and uniform.

The modular outdoor kitchen components described herein include a monolithic base and one or more insertable components. The one or more insertable components may include: a set of three drawers, a set of two drawers, a single drawer (such as but not limited to a garbage drawer), a storage component with a hinged door, a sink, a refrigerator, a cooler, or the like. Generally, the insertable components are made from stainless steel, however, it should be understood that the insertable components may be made from any other sufficiently durable material for withstanding environmental conditions in an outdoor environment.

The monolithic bases are generally cube shaped, but other shapes are possible. Referring to FIGS. 1A-1F, shown therein is a set of four modular outdoor kitchen components s, each having a monolithic base and at least one insertable component therein.

Figure 1B:
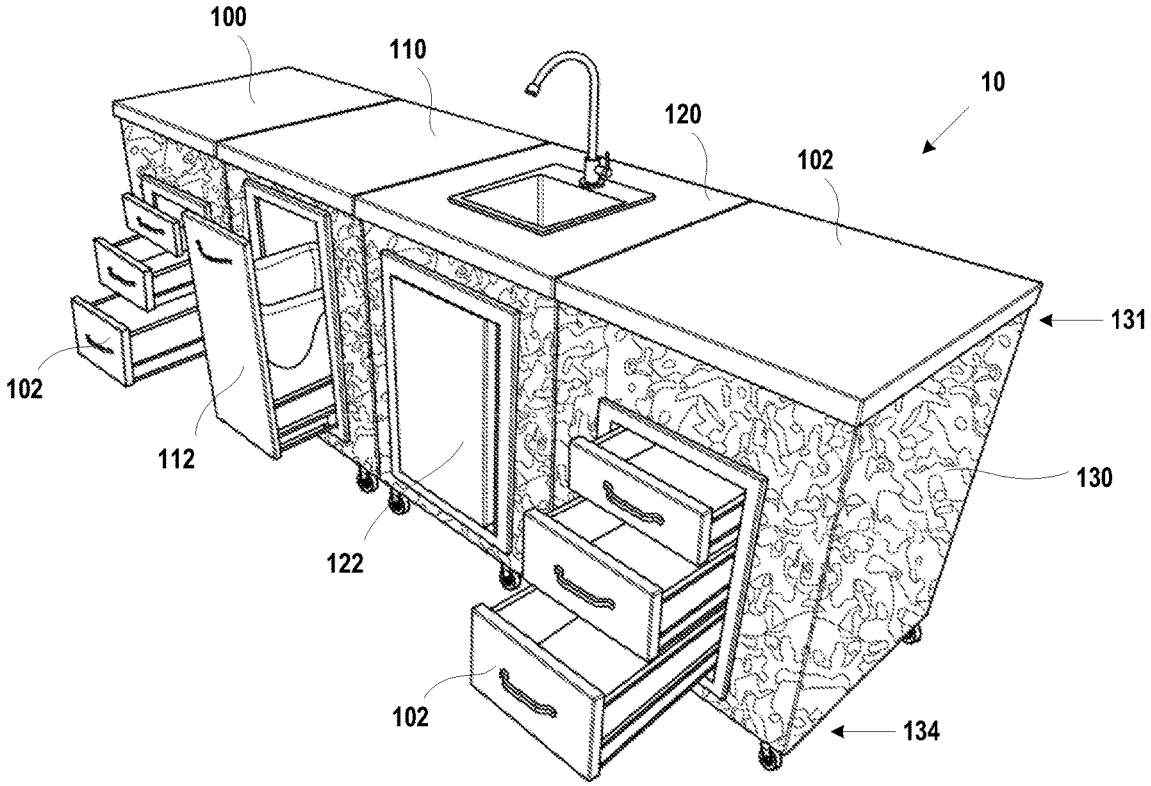
FIG. 1B is a front perspective view of a set of four modular outdoor kitchen components, according to at least one embodiment described herein.
Figure 1D:
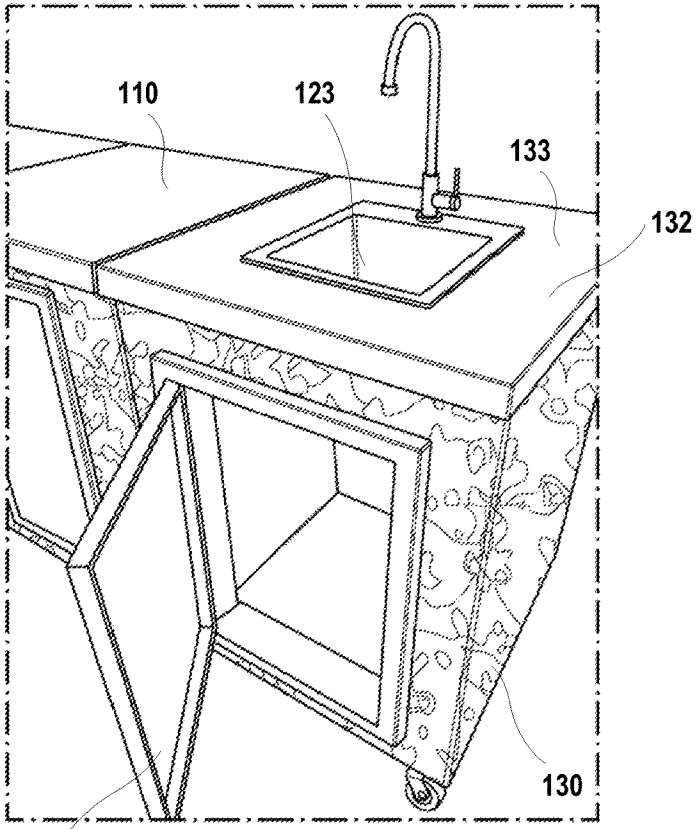
FIG. 1D is a front perspective view of a sink modular outdoor kitchen component, according to at least one embodiment described herein.
Figure 1C:
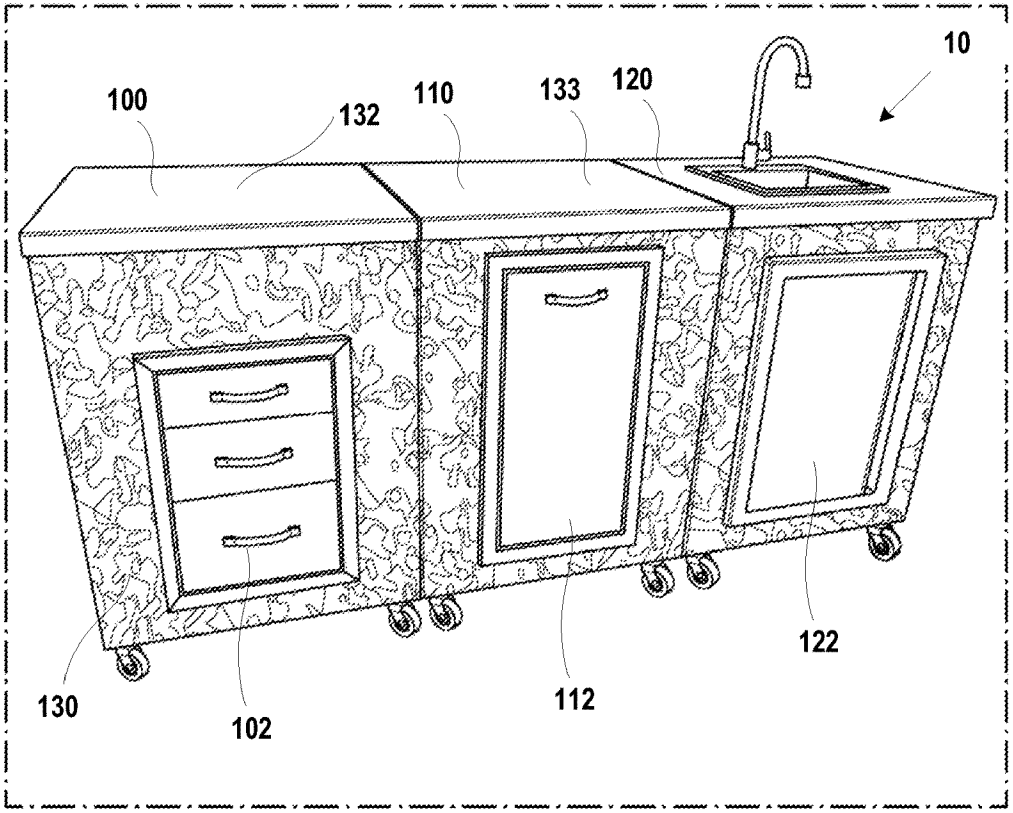
FIG. 1C is a front perspective view of a set of three modular outdoor kitchen components, according to at least one embodiment described herein.
Figure 1F:
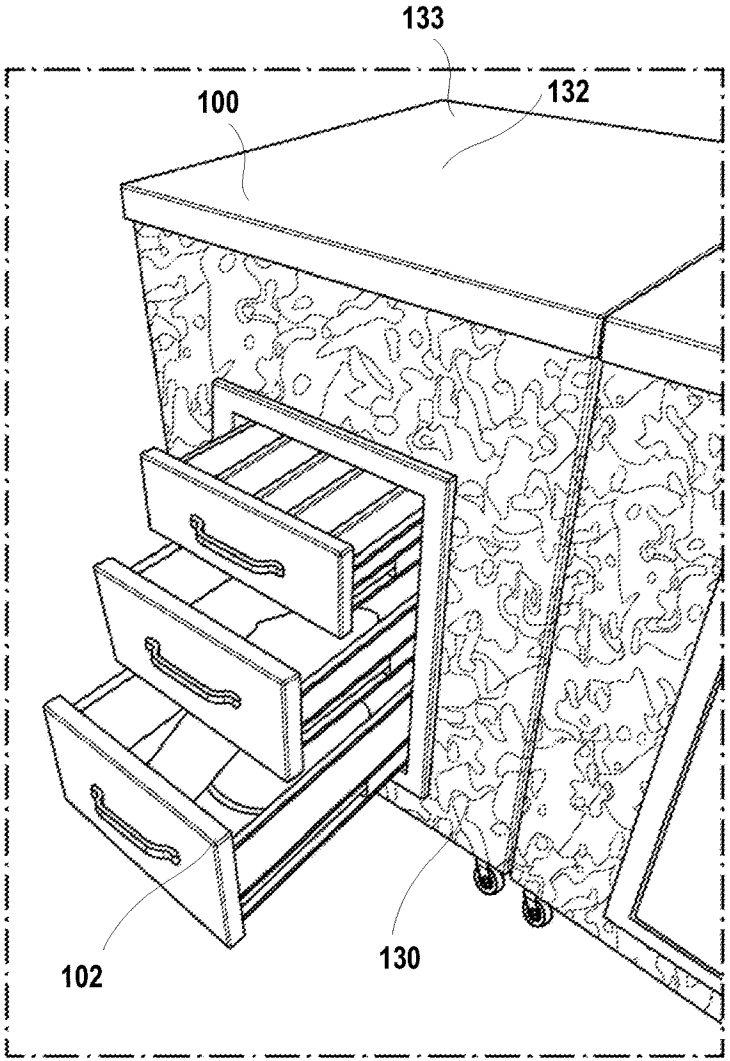
FIG. 1F is a front perspective view of a three drawer modular outdoor kitchen component, according to at least one embodiment described herein.
Figure 1E:
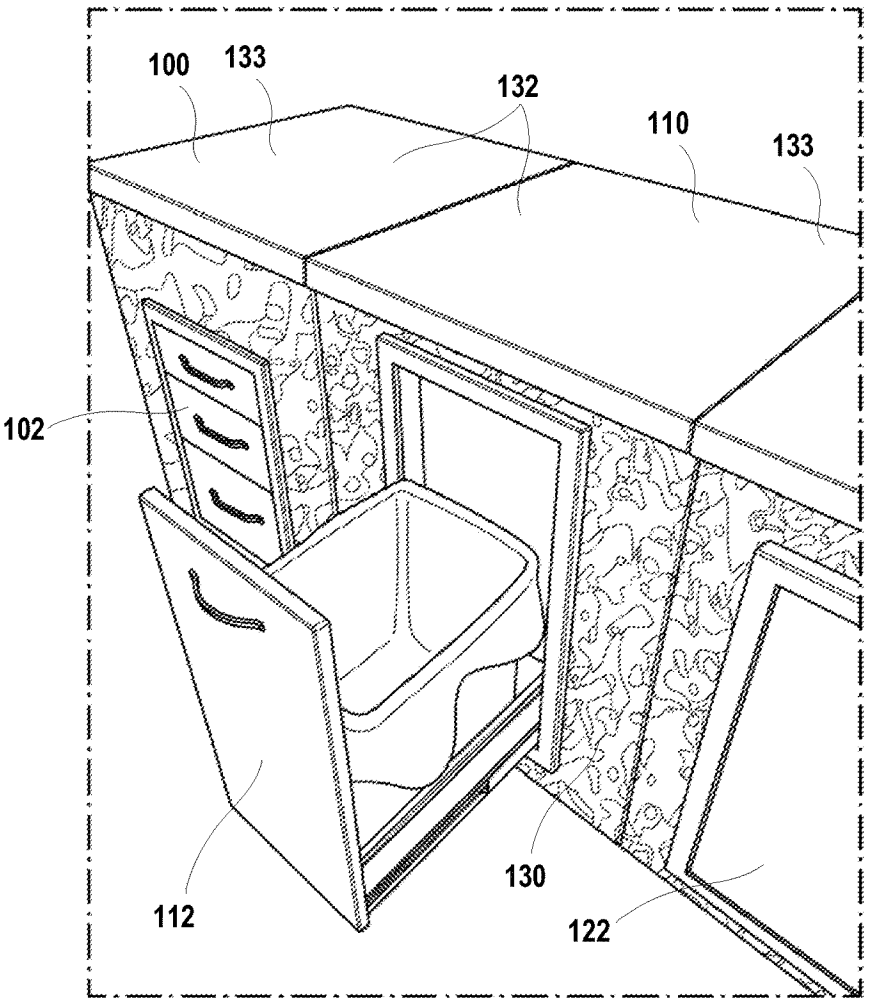
FIG. 1E is a front perspective view of a garbage drawer modular outdoor kitchen component, according to at least one embodiment described herein.
Figure 2B:
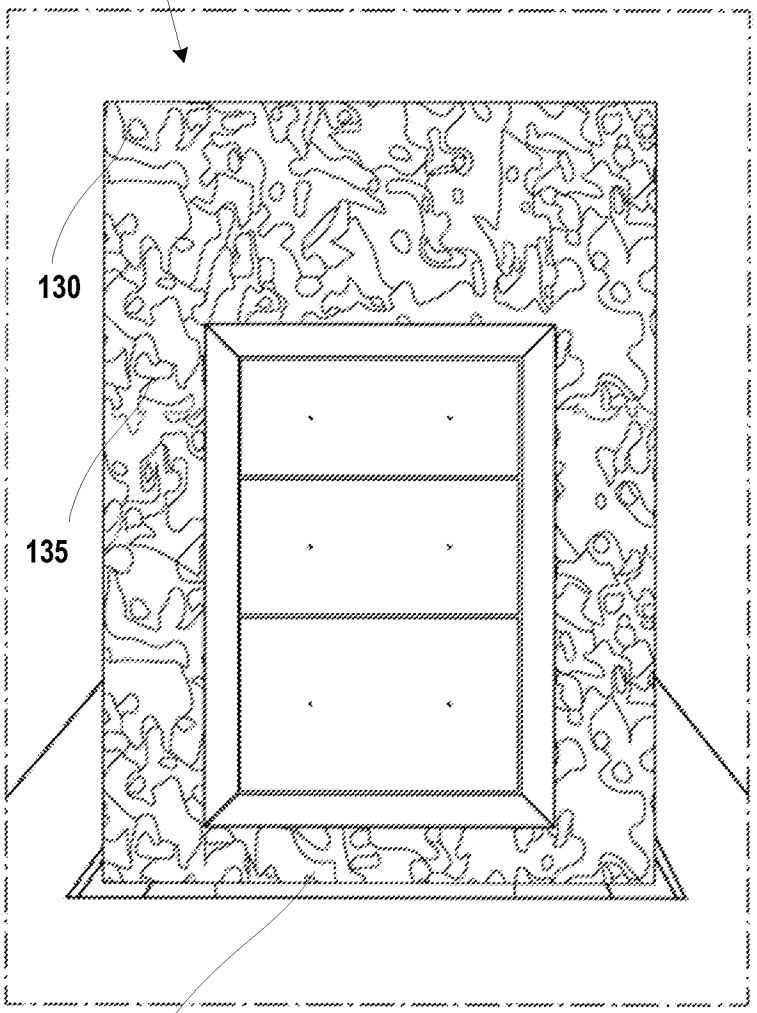
FIG. 2B is a front view of the modular outdoor kitchen component of FIG. 2A.
Figure 2A:
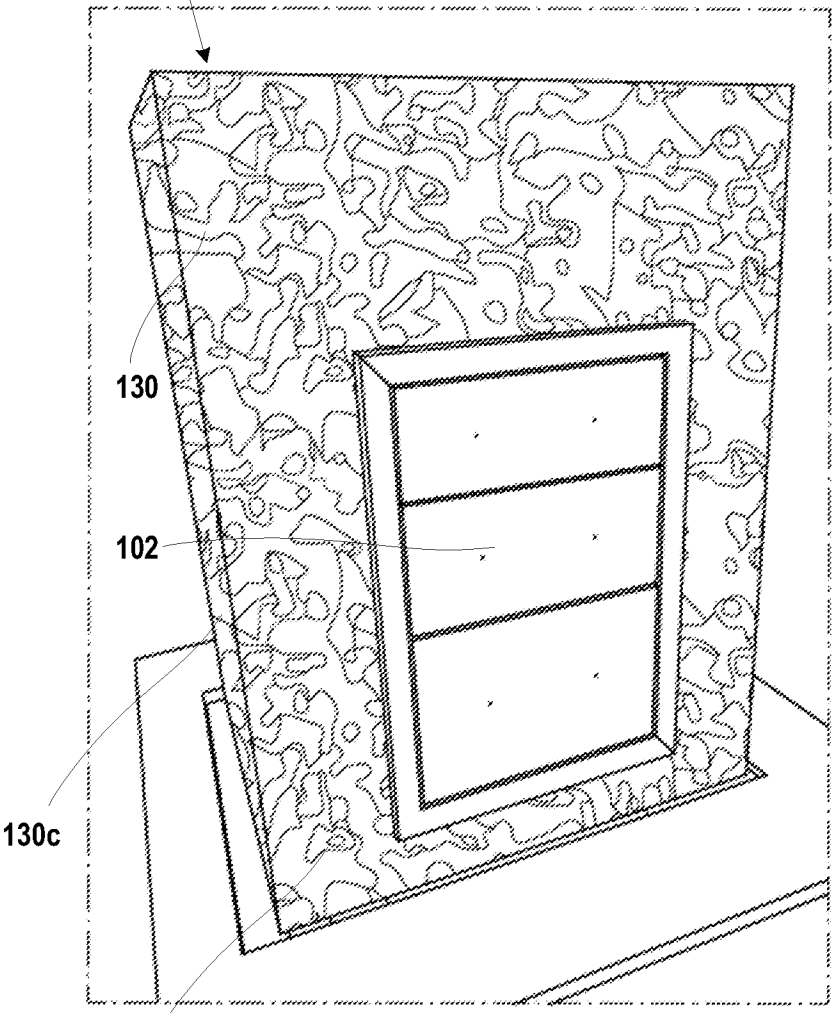
FIG. 2A is a perspective view of a modular outdoor kitchen component, according to at least one embodiment described herein.
Figure 2D:
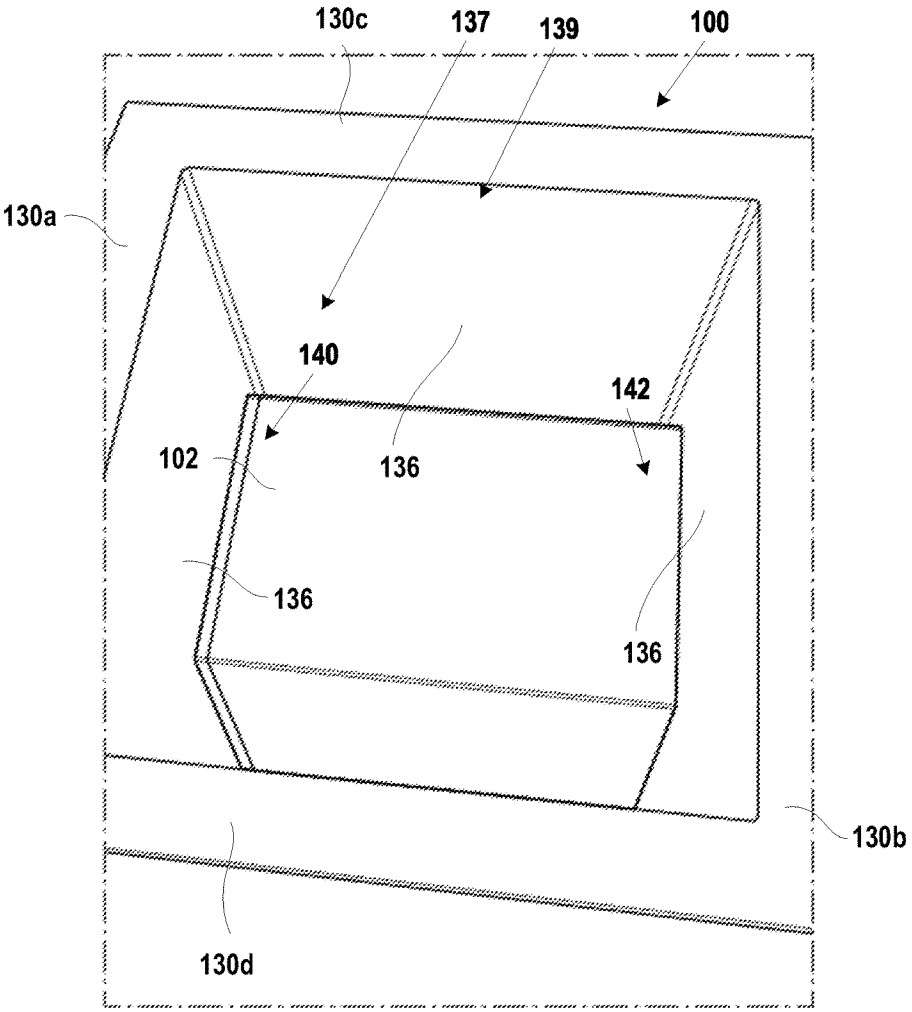
FIG. 2D is another top down view into the cavity of the modular outdoor kitchen component of FIG. 2A.
Figure 2C:
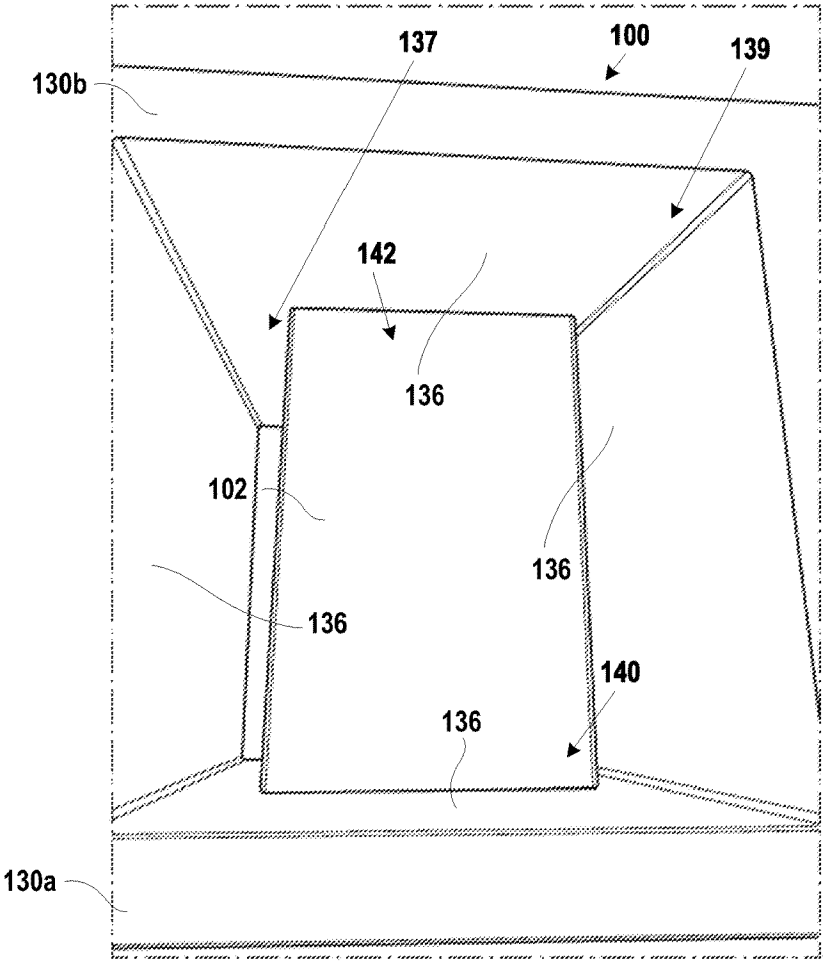
FIG. 2C is a top down view into a cavity of the modular outdoor kitchen component of FIG. 2A.
Figure 2F:
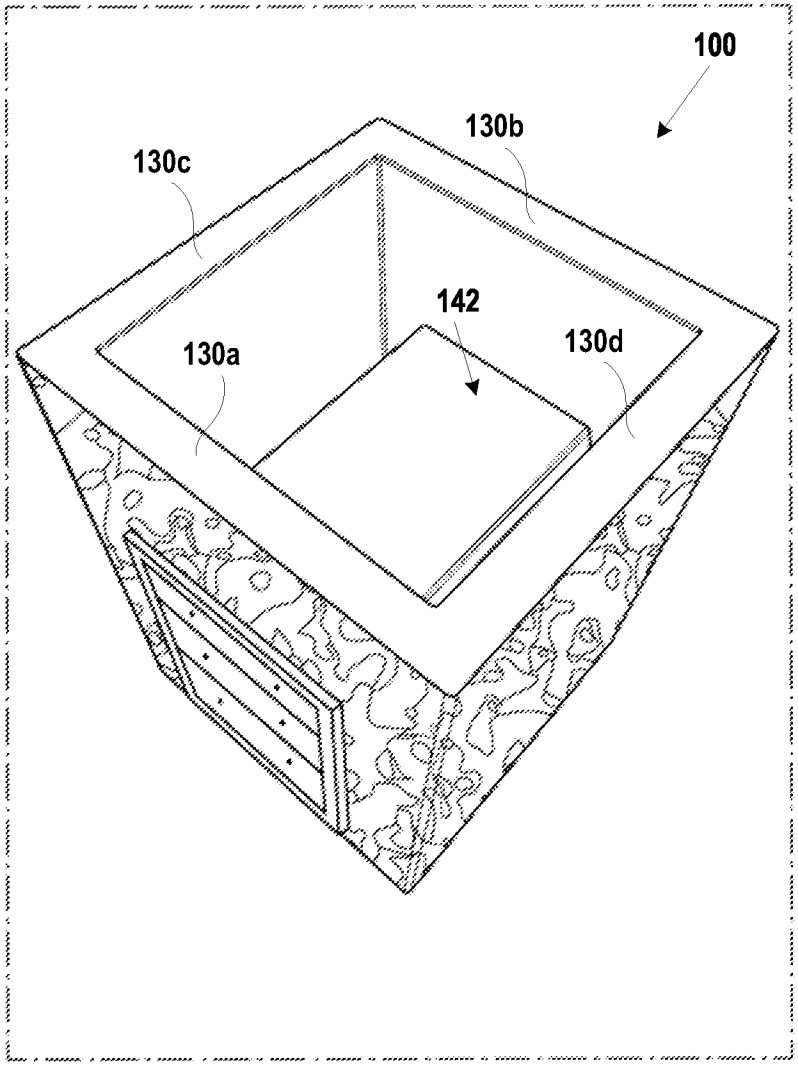
FIG. 2F is a perspective view of the modular outdoor kitchen component of FIG. 2A.
Figure 2E:
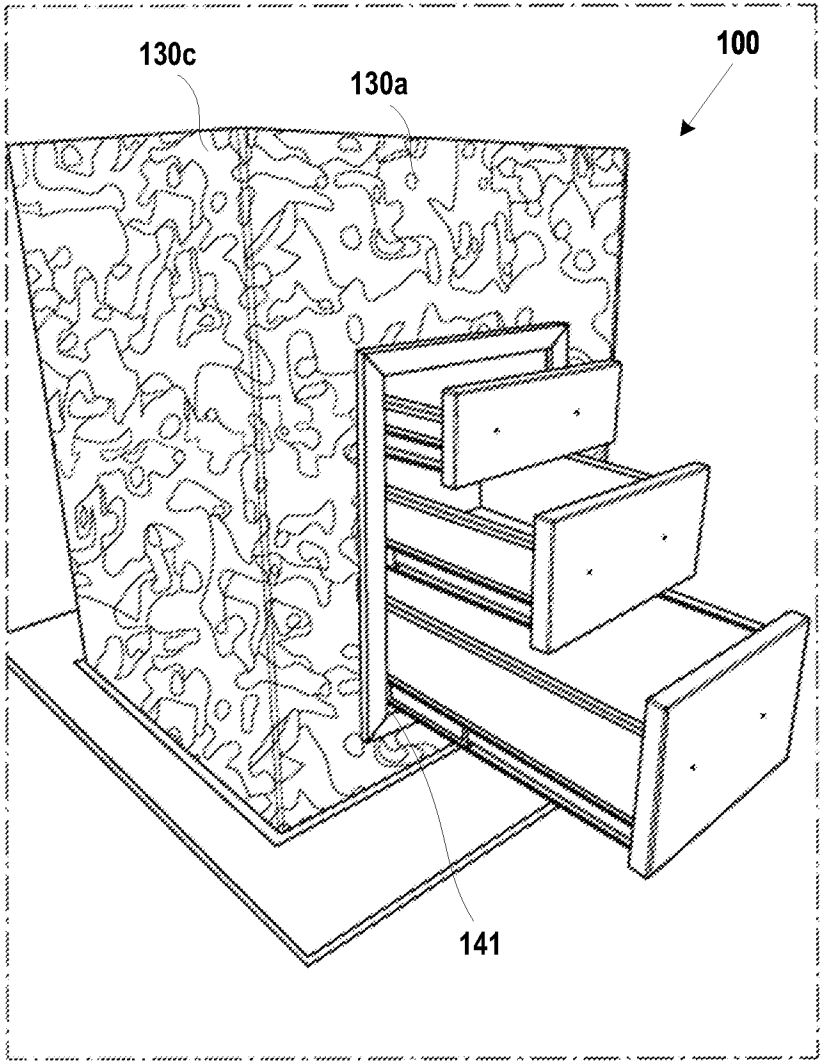
FIG. 2E is a perspective view of the modular outdoor kitchen component of FIG. 2A showing the insertable component in an extended position.

More specifically, FIG. 1A is a front perspective view of an exemplary outdoor kitchen 10 including four modular outdoor kitchen components coupled to each other. The outdoor kitchen 10 includes three different types of modular outdoor kitchen components. The three different types of modular outdoor kitchen components include a first modular outdoor kitchen component 100 coupled to a second modular outdoor kitchen component 110, the second modular outdoor kitchen component 110 coupled to a third modular outdoor kitchen component 120, and the third modular outdoor kitchen component 120 coupled to a second of the first modular outdoor kitchen component 100. FIG. 1B shows a second front perspective view of the outdoor kitchen 10 of FIG. 1A where three of the insertable components are shown in an open orientation. FIG. 1C is a front perspective view of three of the four modular outdoor kitchen components s of the outdoor kitchen 10. FIGS. 1D, 1E and 1F are all partial front perspective views of one of the modular outdoor kitchen components s of the outdoor kitchen 10 with their insertable components therein shown in an open orientation.

In FIG. 1A-1F, each modular outdoor kitchen component 100, 110, 120 contains a different insertable component. More specifically, first modular outdoor kitchen component 100 includes a first insertable component 102, the first insertable component 102 including a set of three drawers, second modular outdoor kitchen component 110 includes a second insertable component 112, the second insertable component 112 including a single garbage drawer, and third modular outdoor kitchen component 120 includes a third insertable component 122 and a fourth insertable component 123, the third insertable component 122 including a lower cabinet and the fourth insertable component 123 including a sink. FIG. 1B shows another front perspective view of outdoor kitchen 10. In at least one embodiment, the insertable components described herein may be may of stainless steel.

Each modular outdoor kitchen component 100, 110, 120 includes a monolithic base 130 having a first end 131 configured to support a top member 132 having a working surface 133 (e.g. a countertop or the like), and a second end 134. Each monolithic base 130 also has four walls, specifically a front wall 130*a*, a rear wall 130*b* and two opposed side walls 130*c*, 130*d*. These are shown in FIGS. 2A-2F.

Each wall has an exterior surface 135 and an interior surface 136 as the monolithic base 130 is generally hollow. The four interior surfaces (or faces) 136 of the walls 130*a*, 130*b*, 130*c*, 130*d* of the monolithic base 130 define an internal cavity 137 of the monolithic base 130.

Each insertable component, such as but not limited to insertable components 102, 112 and 122, is insertable into the cavity 137 of the monolithic base 130 through an opening 138 in at least one of the walls 130*a*, 130*b*, 130*c*, 130*d* of the monolithic base 130. In the examples shown in the drawings, each insertable component is inserted through an opening 138 (see FIG. 5C) present in a front wall 130*a* of the base 130, however, it should be understood that one or more insertable components may also be inserted through an opening 138 present in one or more of the other walls of the monolithic base 100, including but not limited to an upper opening 139.

The first end of the monolithic base 130 is defined by upper edges of each of the walls 130*a*, 130*b*, 130*c*, 130*d* of the base 130. Generally, the walls 130*a*, 130*b*, 130*c*, 130*d* have a height in a range of about 24 inches to about 48 inches, however, the walls may have heights greater than 48 inches and less than 24 inches. In some embodiments, the walls 130*a*, 130*b*, 130*c*, 130*d* have a height of about 30 inches. Generally, each of the walls 130*a*, 130*b*, 130*c*, 130*d* has a same height to provide to the top member 132 to be supported equally by each of the walls 130*a*, 130*b*, 130*c*, 130*d*. One skilled in the art will understand that the top member 132 may also be supported by three of the walls 130*a*, 130*b*, 130*c*, 130*d* or two of the walls 130*a*, 130*b*, 130*c*, 130*d*, if desired. A top wall (not shown) may optionally be included to at reduce a size of, or optionally completely cover, opening 139 into cavity 137.

In some embodiments, the top member 132 may be adhered to the monolithic base 130, such as by a glue, an epoxy or the like. In some embodiments, the top member 132 may be unadhered to the monolithic base 130. This may provide for a user to have access to the cavity 137 within the monolithic base 130 when the top member 132 is removed.

In at least one embodiment, at least a portion of the inner surface 136 of the walls 130*a*, 130*b*, 130*c*, 130*d* may be recessed inwardly and be configured to receive at least a portion of a component of the modular outdoor kitchen components 102, 112, 122. This can be seen, for example, in FIG. 4G. For example, in the examples shown in the drawings, an insertable component 102, 112, 122 may include a frontward portion 140 and a rearward portion 142, the frontward portion 140 being supported within an opening 138 of the monolithic base 130 by a lower edge 141 of opening 138 in the front wall 130*a* of the monolithic base 130 and the rearward portion 142 being supported by a lower edge 144 of a recessed portion 145 (see FIG. 5H) of a rear wall 130*b* of the monolithic base 130. In this manner, the insertable component may be inserted into the cavity 137 of the monolithic base 130 but not visible from a rear perspective as the rear wall 130*b* of the monolithic base 130 may have continuous rear exterior face (e.g., the insertable component may not be visible from the rear exterior face 130*b*).

In some embodiments, both a front wall 130*a* and a rear wall 130*b* may define openings 138 to receive a front portion 140 and a rear portion 142, respectively, of an insertable component.

The monolithic base 130 may be made of any material that is suitable for withstanding environmental conditions of an outdoor environment, including but not limited to concrete, wood, plastic and the like. In at least one embodiment, the monolithic base 130 may be made of a material that is suitable for providing a pattern or textured finish, such as but not limited to patterned concrete.

In some embodiments, monolithic base 130 may be configured to have one or more wheels 146 extending from a lower end 147 thereof.

In some embodiments, monolithic base 130 may include a kick plate (not shown), for example made of wood, to lift lower end 147 above a ground and inhibit moisture from the ground contacting lower end 147.

In at least one embodiment, the monolithic base 130 may include a secondary opening (not shown) in one or more of the walls 130*a*, 130*b* 130*c* 130*d* to provide for an electrical box to be housed within the insertable component 102. A secondary opening will typically have a smaller length and width than opening 138 for housing the insertable component of the module 100.

In at least one embodiment, the monolithic base may include a secondary opening (not shown) to provide for a water supply line to be inserted to cavity 137 of the monolithic base 130 and/or into an insertable component thereof (e.g. a water tap).

In at least one embodiment, the monolithic base 130 may include a secondary opening (not shown) to provide for a drain to direct fluid outwardly from cavity 137 the monolithic base 130 and/or to an insertable component thereof (e.g., a sink).

In at least one embodiment, adjacent monolithic bases (e.g. 100, 110) may be coupled to one another, for example by a fastener or an adhesive.

In at least one embodiment, adjacent monolithic bases (e.g. 100, 110) may be uncoupled to one another.

In at least one embodiment, the insertable component 102 may be coupled to the monolithic base 100, for example, by a fastener or an adhesive.

In at least one embodiment, the monolithic base 130 may be uncoupled to the insertable component 102.

Referring now to FIGS. 3A to 3D, illustrated therein are one or more tools used in the formation of the monolithic base 130.

For example, FIGS. 3A to 3D show a form 300 having an inner frame 302 and an outer frame 304, each coupled to a lower support member 306 to retain the material being used to form the monolithic base within a cavity 308 therebetween.

The outer frame 304 includes four wall members 304*a*, 304*b* 304*c*, 304*d* coupled together to form a square or rectangle having four corners. In other embodiments, other shapes and a different number of wall members may be possible (e.g. five wall members to forma pentagon, six wall members to form a hexagon, eight wall members to form an octagon, etc.)

Figure 3A:
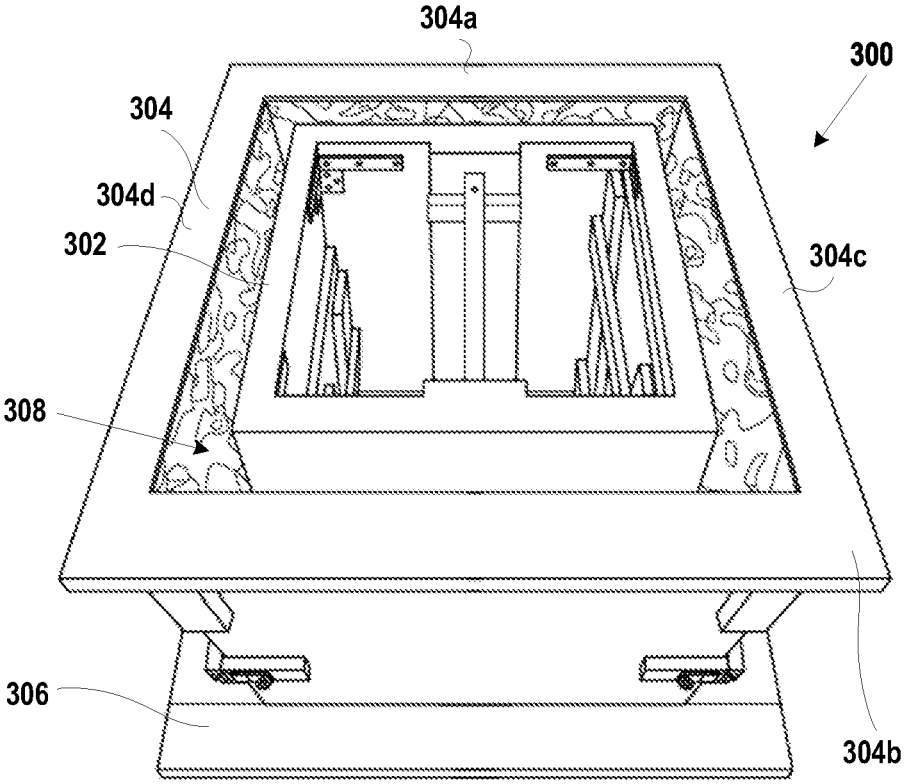
FIG. 3A is a perspective view from above of a form for providing a modular outdoor kitchen component, according to at least one embodiment described herein.
Figure 3B:
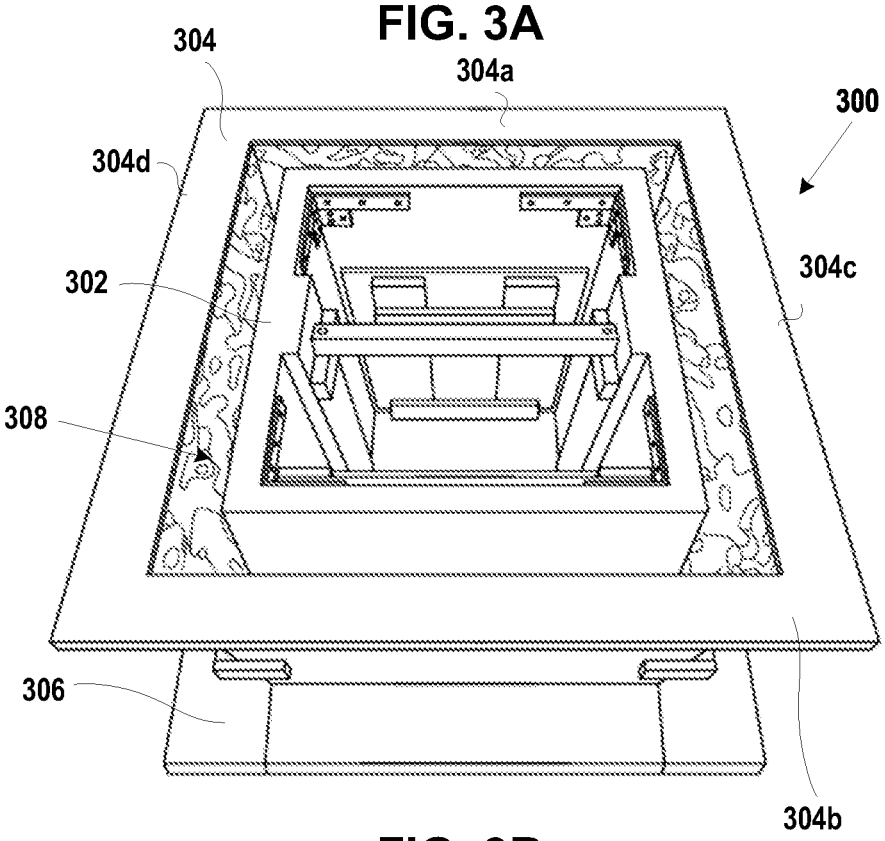
FIG. 3B is a perspective view from above of a form for providing a modular outdoor kitchen component, according to at least one embodiment described herein.
Figure 3C:
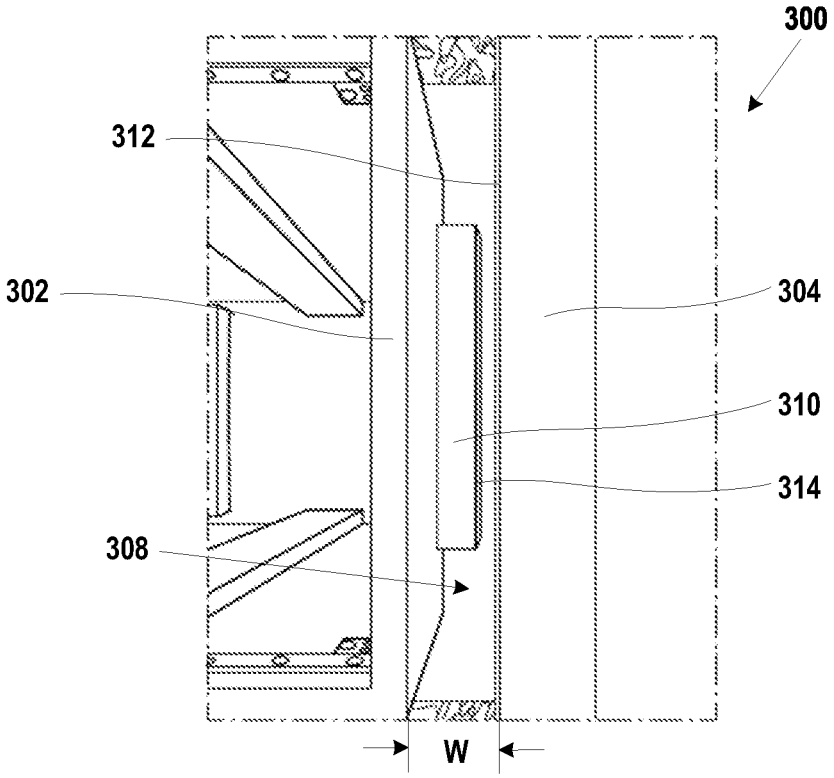
FIG. 3C is a magnified top view of a first portion of the form for providing a modular outdoor kitchen component of FIG. 3A, according to at least one embodiment described herein.
Figure 3D:
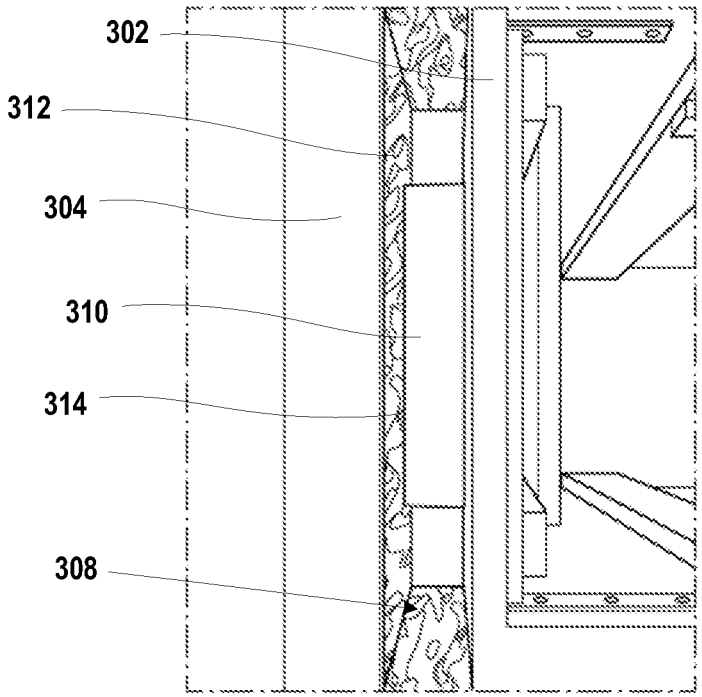
FIG. 3D is a magnified top view of a second portion of the form for providing a modular outdoor kitchen component of FIG. 3A, according to at least one embodiment described herein.

As shown in FIGS. 3C and 3D, in some embodiments, the outer frame 304 and/or the inner frame 302 may include one or more protruding portions 310 to form the openings and/or recessed portions of the monolithic base 130, such as but not limited to opening 138 and/or recessed portion 144 as described above. For example, the inner frame may include a protruding portion 310 that extends into the cavity 308 for retaining the material to be used to provide the monolithic base 130 by a distance that is less than a width W of the cavity 308. Here, as the material being used to provide the monolithic base 130 is inserted into the cavity 308, the material will rest between the inner surface 312 of the outer frame 304 and the protruding surface 314 of the protruding portion 310 of the inner frame 302. The resulting monolithic base 130 will subsequently have a recessed portion 145 that matches in size and shape to the size and shape of the protruding portion 314 of the inner frame 302. Accordingly, if protruding portion 310 extends into the cavity 308 for retaining the material to be used to provide the monolithic base 130 by a distance that is equal than width W of the cavity 308, an opening 138 will be formed in the monolithic base 130.

The four wall members 304*a*, 304*b* 304*c*, 304*d* of the outer frame 304 may be removably coupled to one another to provide for removing them individually once the material to be used to form the monolithic base has been inserted into the cavity 308 formed by the inner frame 302, the outer frame 304 and the lower support member 306.

In at least one embodiment, an inner surface 312 of the outer frame 304 and/or an outer surface 316 of the inner frame 302 may include a releasing agent to facilitate release of the material being used to provide the monolithic base 130 from the inner frame 302 and the outer frame 304. The releasing agent may be adhered to the inner surface 312 of the outer frame 304 and/or an outer surface 316 of the inner frame 302 or may be applied (e.g., sprayed) to the inner surface 312 of the outer frame 304 and/or an outer surface 316 of the inner frame 302.

Figure 4A:
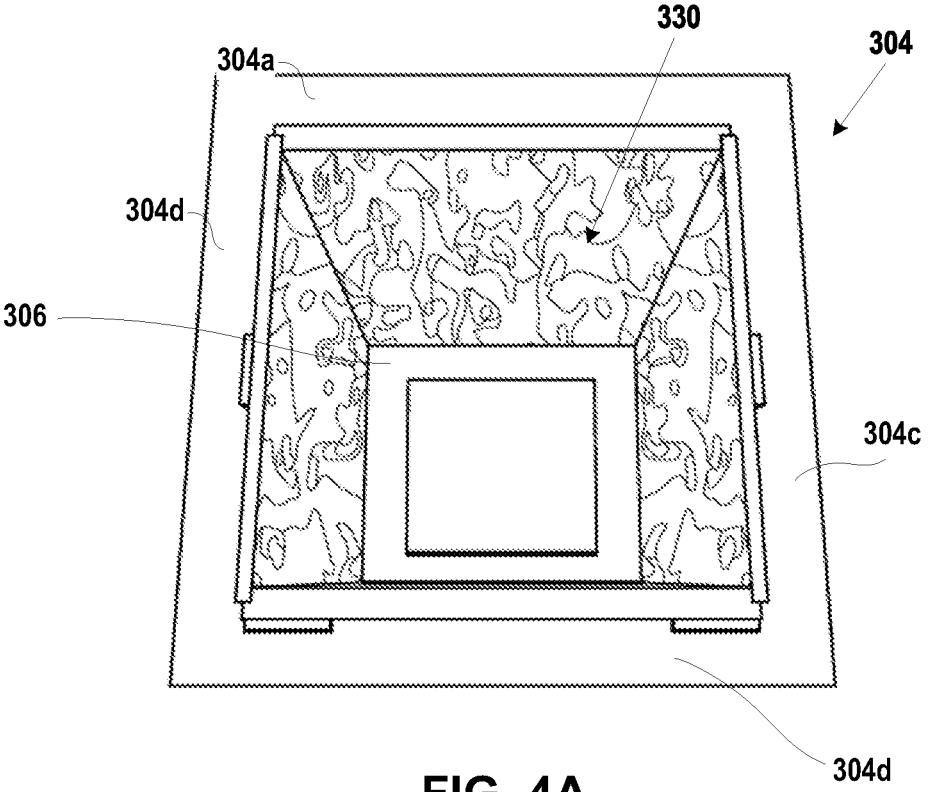
FIG. 4A is a top down view of an outer frame of the form of FIGS. 3A-3D.
Figure 4B:
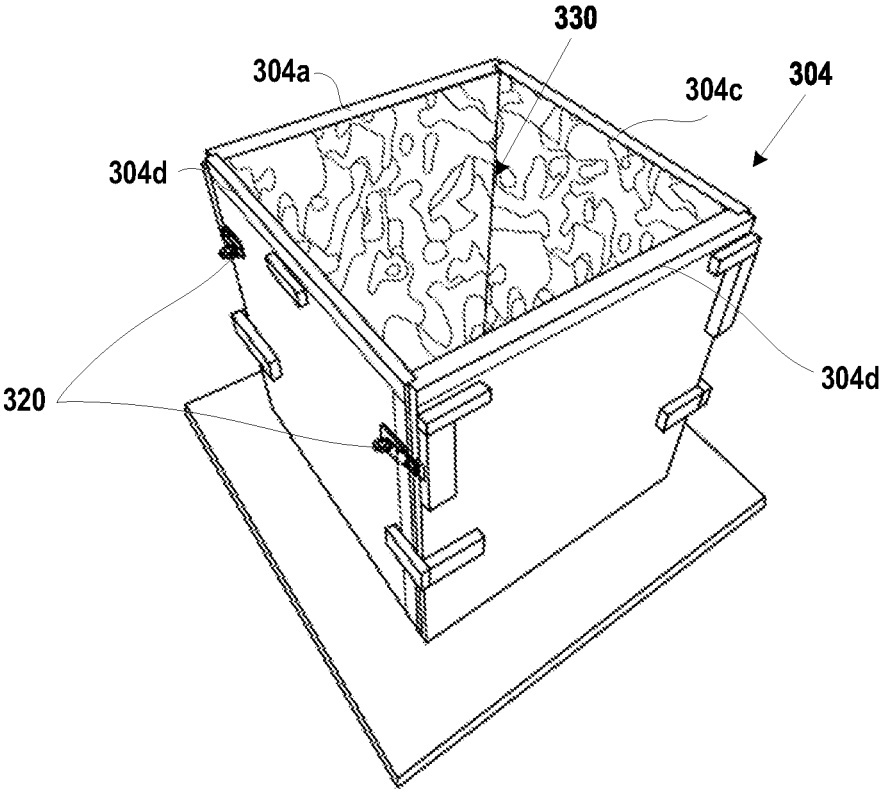
FIG. 4B is a perspective view of the outer frame.
Figure 4C:
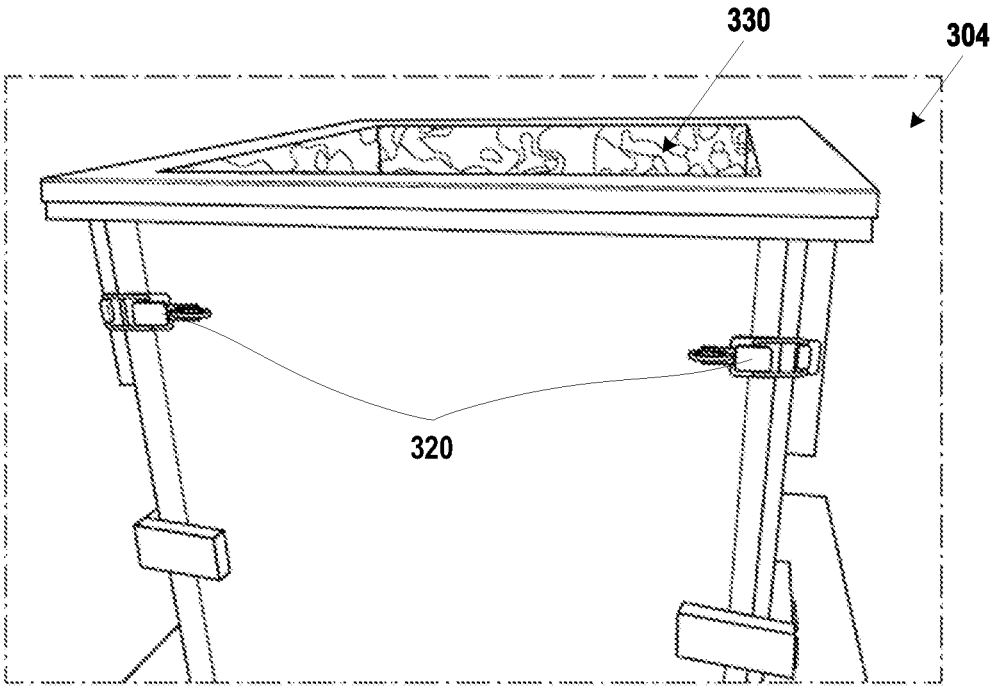
FIG. 4C is a side view of the outer frame.

FIG. 4A is a top down perspective view of an outer frame 304 of the form of FIGS. 3A-3D. FIG. 3B is a perspective view of the outer frame 304. As shown therein, the outer frame 304 may include one or more latches 320 that are used to releasably attach two adjacent of the wall members of wall members 304*a*, 304*b* 304*c*, 304*d* of the outer frame 304 together. The latches 320 provide for each of the wall members 304*a*, 304*b* 304*c*, 304*d* of the outer frame 304 to be individually removed from the monolithic base 130 after the material providing the monolithic base 130 has hardened in the cavity 308 of the form 300. FIG. 4C also shows two laches 320 on an outer surface 322 of the outer frame 304.

Figure 4D:
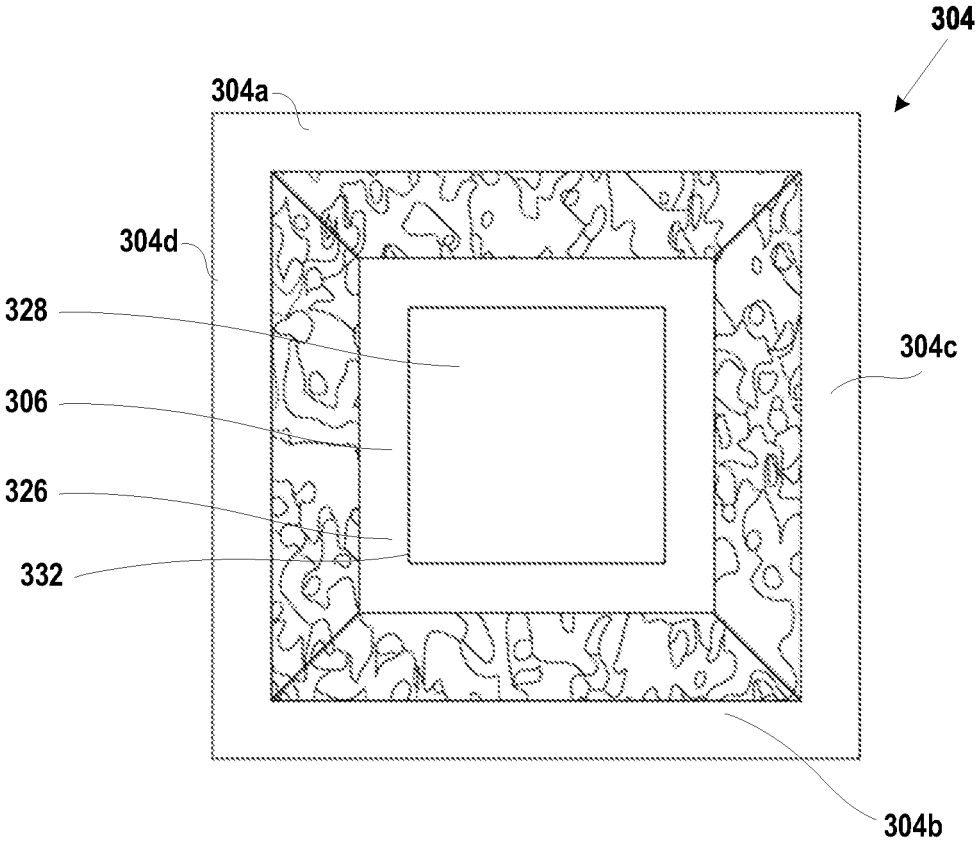
FIG. 4D is a top down view of the outer frame.

FIG. 4D is a top down view of the outer frame 304 where an upper surface 326 of the lower support member 306 is visible. The upper surface 326 of the lower support member 306 is shaped to guide positioning of the inner frame 302. For example, the upper surface 326 of the lower support member 306 may include a protrusion 328 extending upwardly into a cavity 330 of the inner frame 302, an edge 332 of the protrusion 330 guiding a positioning of the inner frame 302 relative to outer frame 304 (e.g. each inner wall member 302*a*, 302*b*, 302*c*, 302*d* may rest against edge 332 within receded portion 333). In the embodiment shown in the drawings, the protrusion 330 has a square shape, however, other shapes are also possible depending on the shape of the inner frame 302 and the outer frame 304 and the desired shape of the monolithic base 130.

Figure 4E:
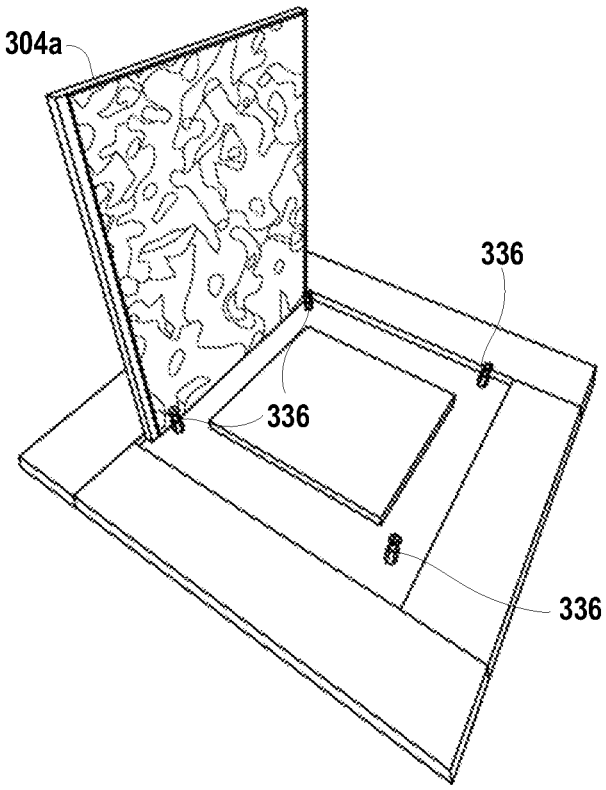
FIG. 4E is a perspective view of a single wall of the outer frame.
Figure 4F:
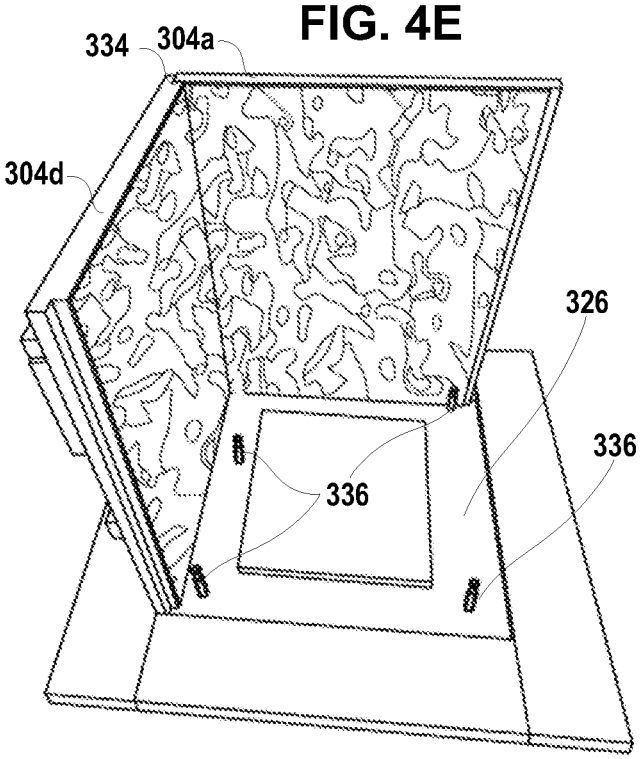
FIG. 4F is a perspective view of two walls of the outer frame coupled to each other at a corner.
Figure 4G:
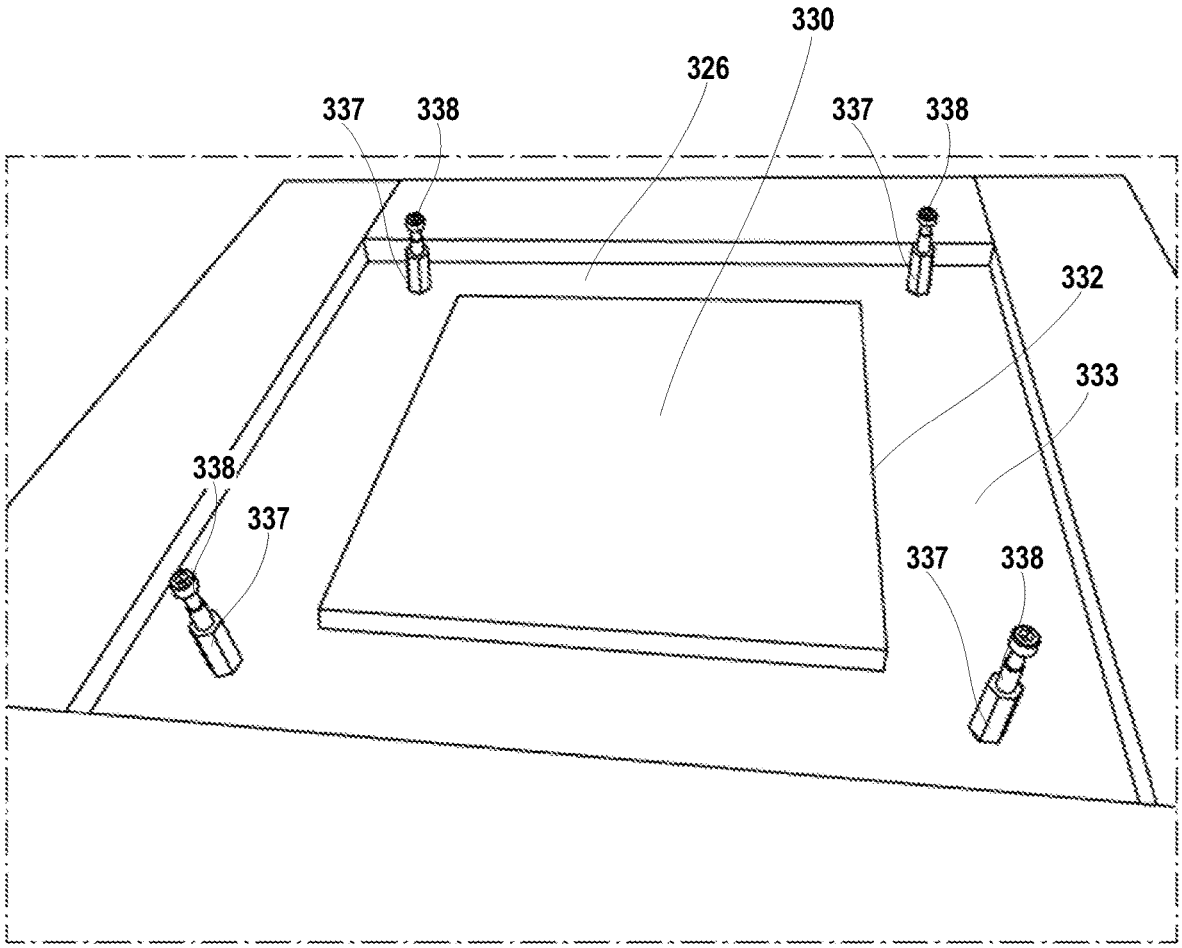
FIG. 4G is a perspective view of a lower support member of the form of FIGS. 3A to 3D.

FIG. 4E is a perspective view of a single wall member 304*a* of the outer frame 304. FIG. 4F is a perspective view of two wall members 304*a*, 304*d* of the outer frame 304 coupled to each other at a corner 334. Thereon, in one embodiment, four coupling devices 336 are shown protruding upwardly from upper surface 326 of the lower support member 306. The four coupling devices 336 may be used to couple four wheels 146 to lower end 147 of the monolithic base 130. In this embodiment, the coupling devices 336 each include a male member 337 and a female member 338. The female member 338 extends upwardly into the cavity 308 where the monolithic base 130 is formed. As the material that provides the monolithic base 130 is inserted into the cavity 308, the female member 338 of the coupling device 336 is embedded in the material. Once the material has hardened into the monolithic base 130, the lower support member 306 is removed from the form 300 and the male member 337 may be exposed from a bottom surface (not shown) of the monolithic base 130. Male member 337 may be removed and female member 338 may remain. A connector (e.g. wheel 146, a leveling member, or the like) can then be inserted into the exposed end of the female member 338 for attaching the connector to the monolithic base 130. FIG. 4G is a perspective view of lower support member 306 of the form 300 of FIGS. 3A to 3D and shows the female members 338 of the coupling devices 336.

Figure 5B:
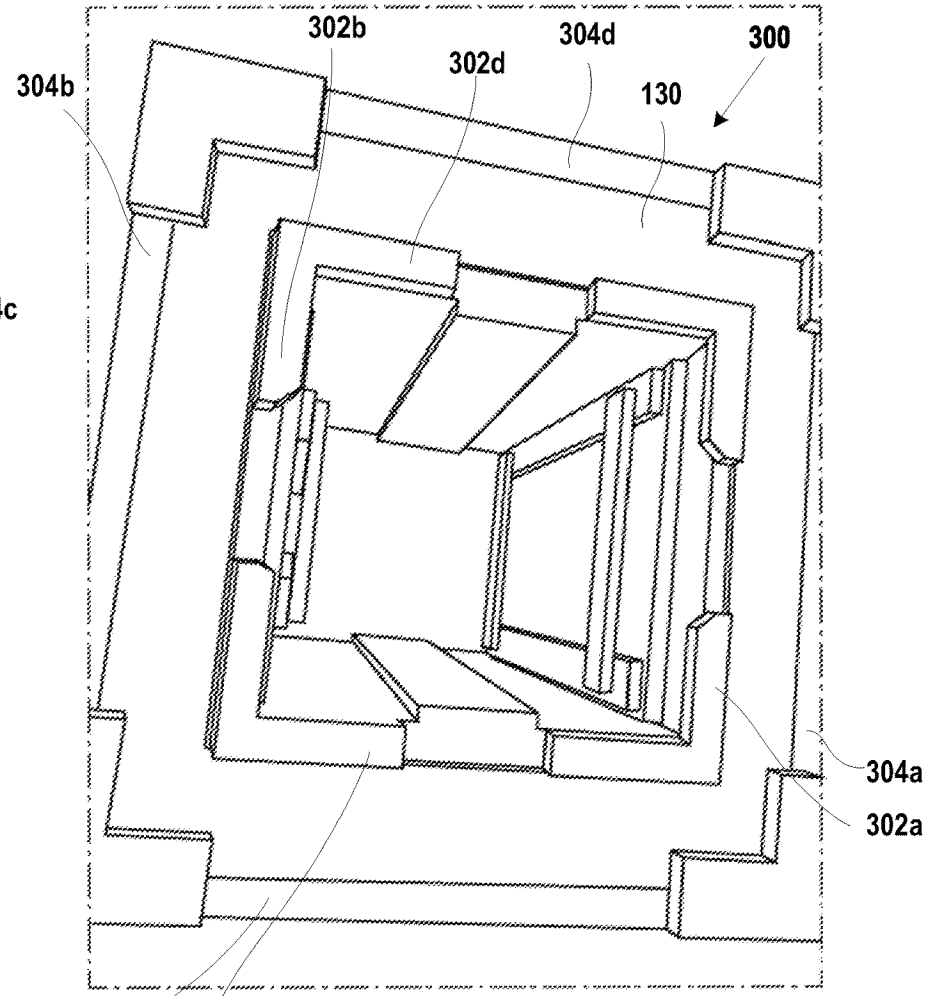
FIG. 5B is a top down view of the form having the material of FIG. 5A.
Figure 5A:
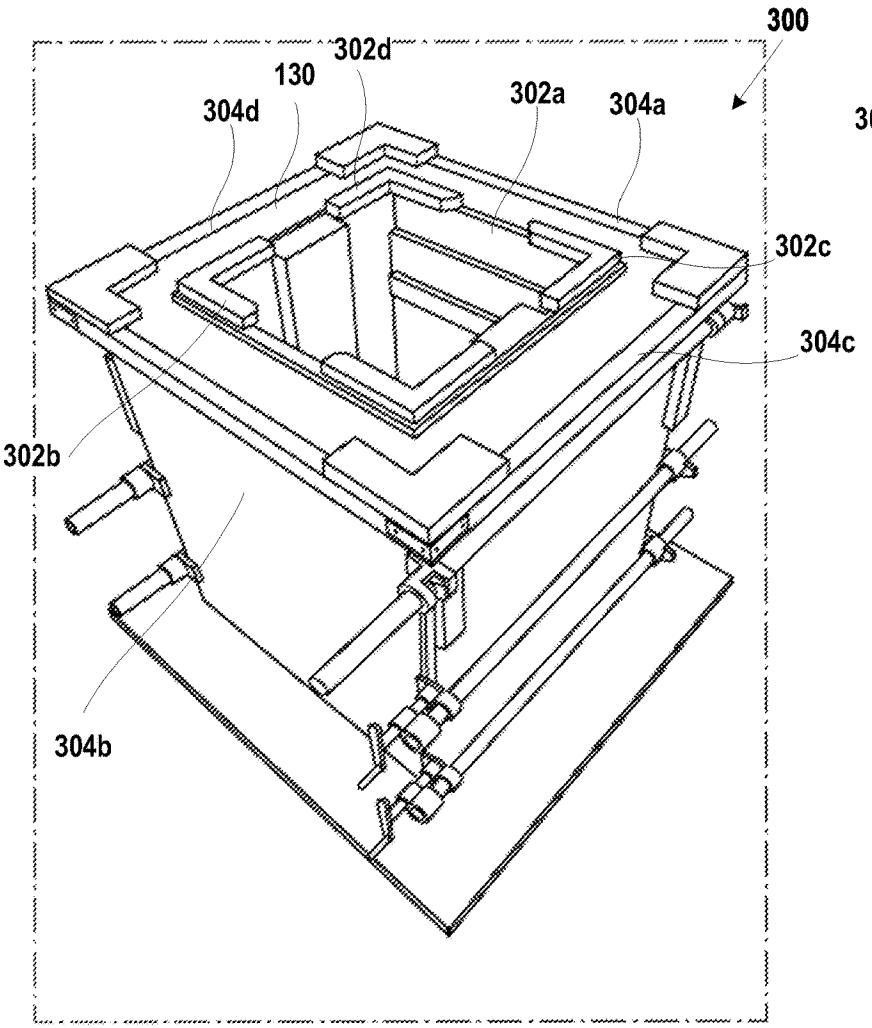
FIG. 5A is a perspective view of the form of FIGS. 3A-3D having a material for forming a monolithic base inserted therein.

FIG. 5A is a perspective view of the form 300 of FIGS. 3A-3D having a material for forming a monolithic base 130 inserted therein. FIG. 5B is a top down view of the form 300 having the material of FIG. 5A.

Figure 5D:
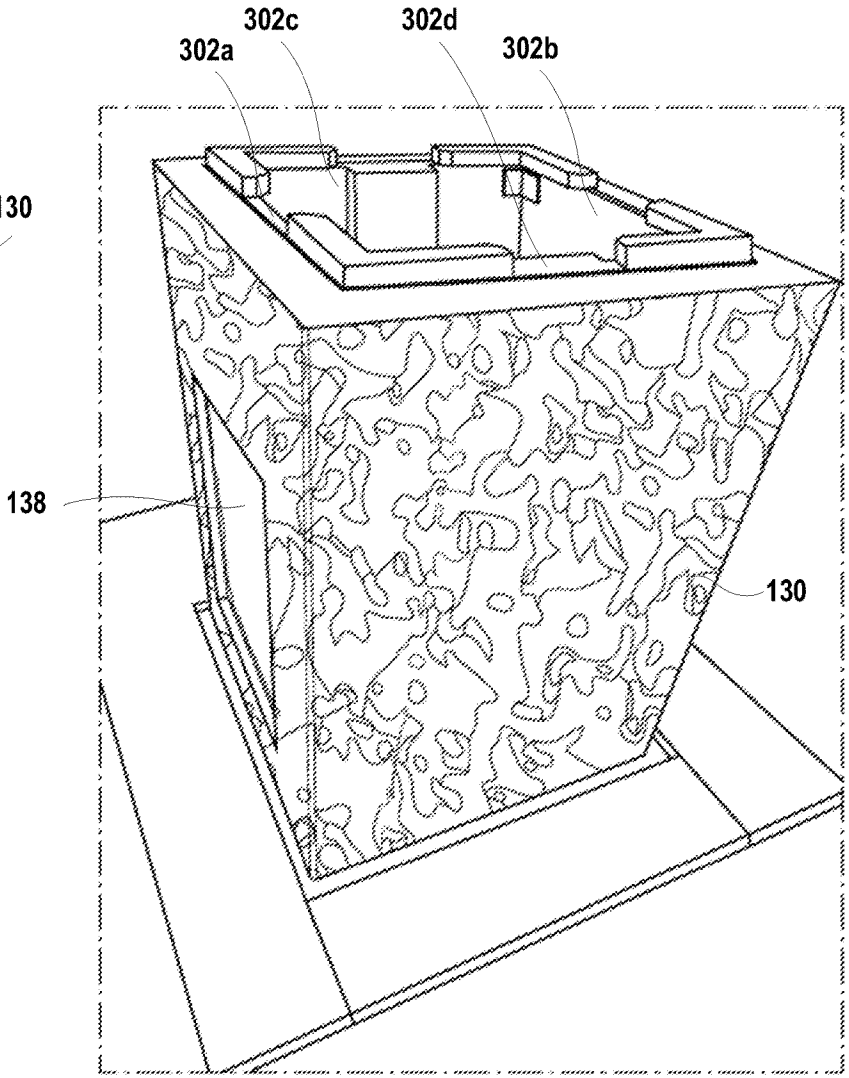
FIG. 5D is a perspective view of the monolithic base formed in FIG. 5A having the outer frame of the form removed therefrom.
Figure 5C:
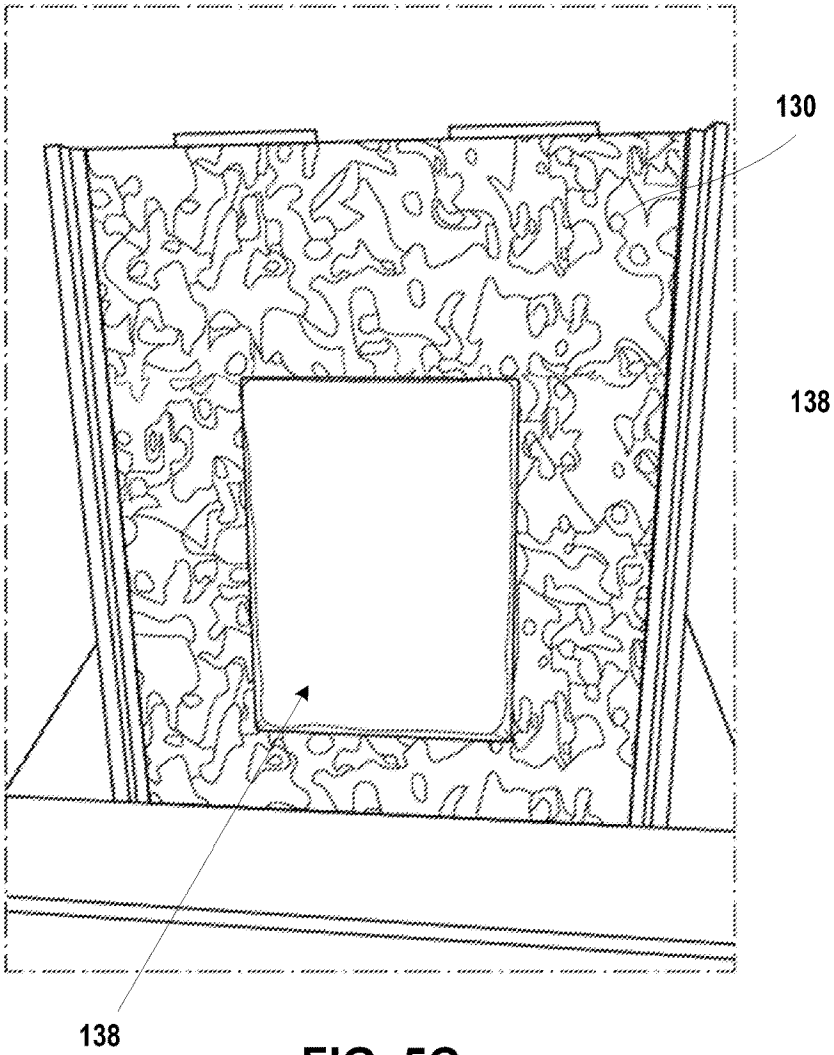
FIG. 5C is a side view of the monolithic base formed in FIG. 5A having the outer frame of the form removed therefrom.

Once the material is hardened, as shown, individual wall members 304*a*, 304*b* 304*c*, 304*d* of the outer frame 304 of the form can be individually removed. FIG. 5C is a side view of the monolithic base 130 formed in FIG. 5A having at least one wall member 304*a* of the outer frame 304 of the form 300 removed therefrom. FIG. 5D is a perspective view of the monolithic base 130 formed in FIG. 5A having each wall member 304*a*, 304*b* 304*c*, 304*d* of the outer frame 304 of the form 300 removed therefrom.

Figure 5F:
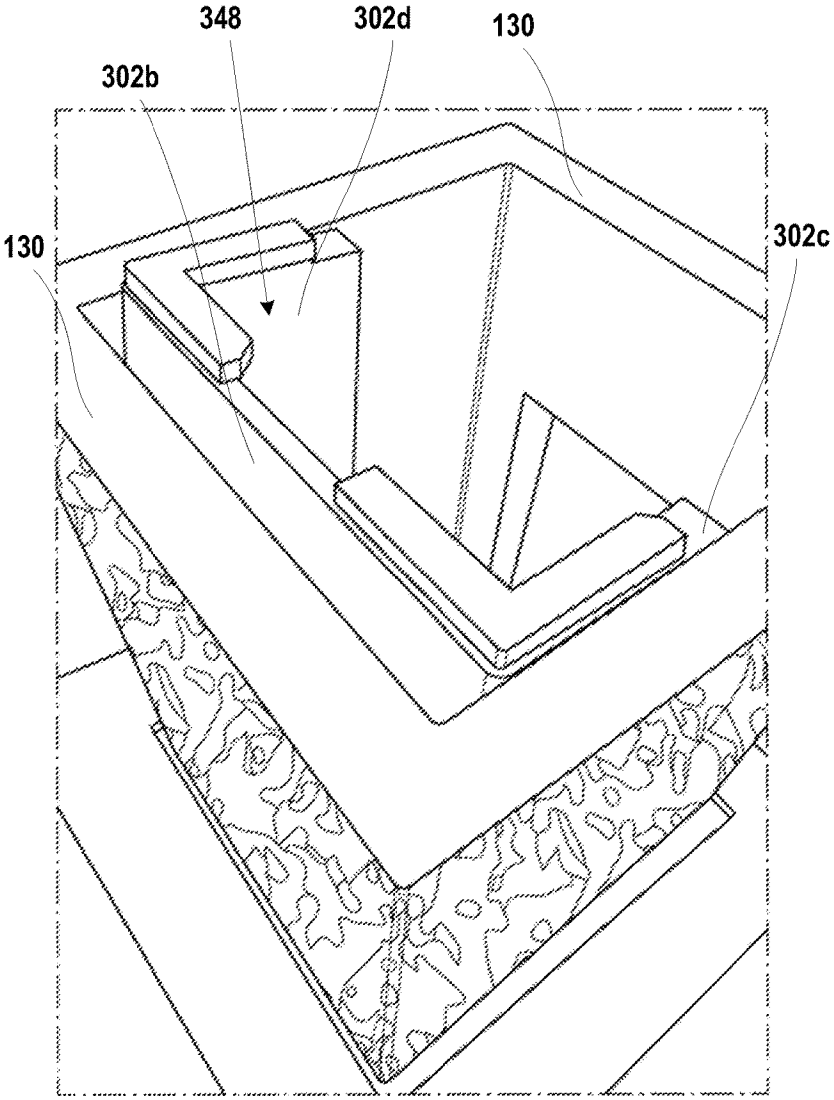
FIG. 5F is a perspective view of the monolithic base formed in FIG. 5A having the outer frame and at least one wall of the inner frame of the form removed therefrom.
Figure 5E:
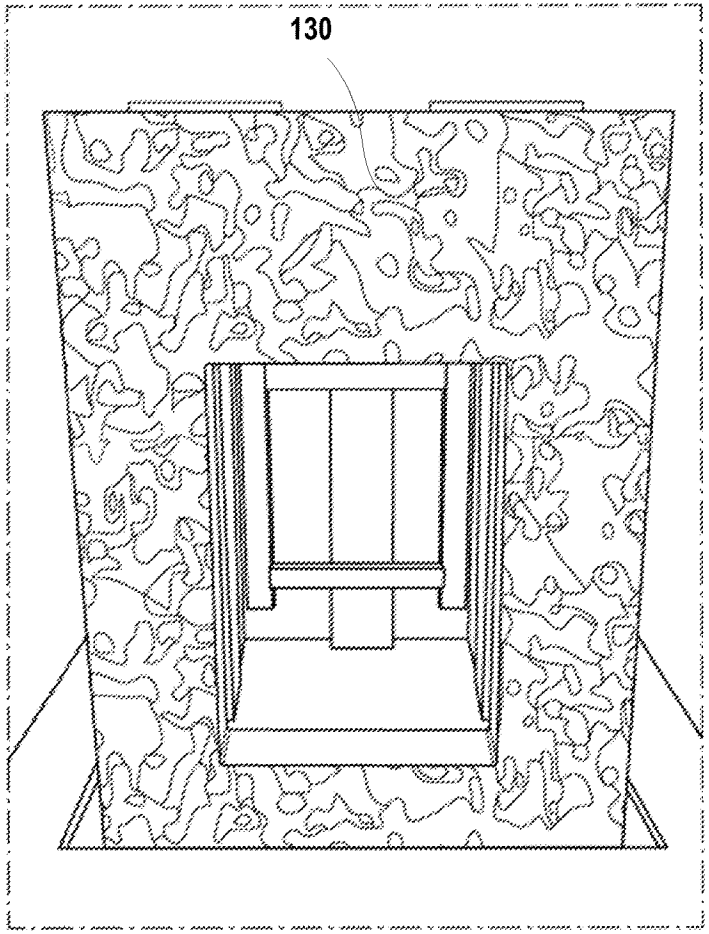
FIG. 5E is a side view of the monolithic base formed in FIG. 5A having the outer frame and at least one wall of the inner frame of the form removed therefrom.

FIG. 5E is a side view of the monolithic base 130 formed in FIG. 5A having the outer frame 304 and at least one wall 302*a*, 302*b*, 302*c*, 302*d* of the inner frame 302 of the form 300 removed therefrom. FIG. 5F is a perspective view of the monolithic base 130 formed in FIG. 5A having the outer frame 304 and at least one wall 302*a* of the inner frame 302 of the form 300 removed therefrom. As shown in FIG. 5F, the inner frame 302 may comprise two or more portions 348 that are detachably coupled together. For example, a first portion 348 may include inner wall portion 302*b* and portions of inner wall portion 302*c* and 302*d*, whereas a second portion 348 (not shown) may include inner wall portion 302*a* and portions of inner wall portion 302*c* and 302*d*. The inner portions 348 may have a same size. The inner wall portions 348 may have different sizes. The inner frame 302 comprising two or more portions 348 that are detachably coupled together may facilitate removing the inner frame 302 from the cavity 137 defined by the monolithic base 130 after the monolithic base 130 has hardened.

Figure 5H:
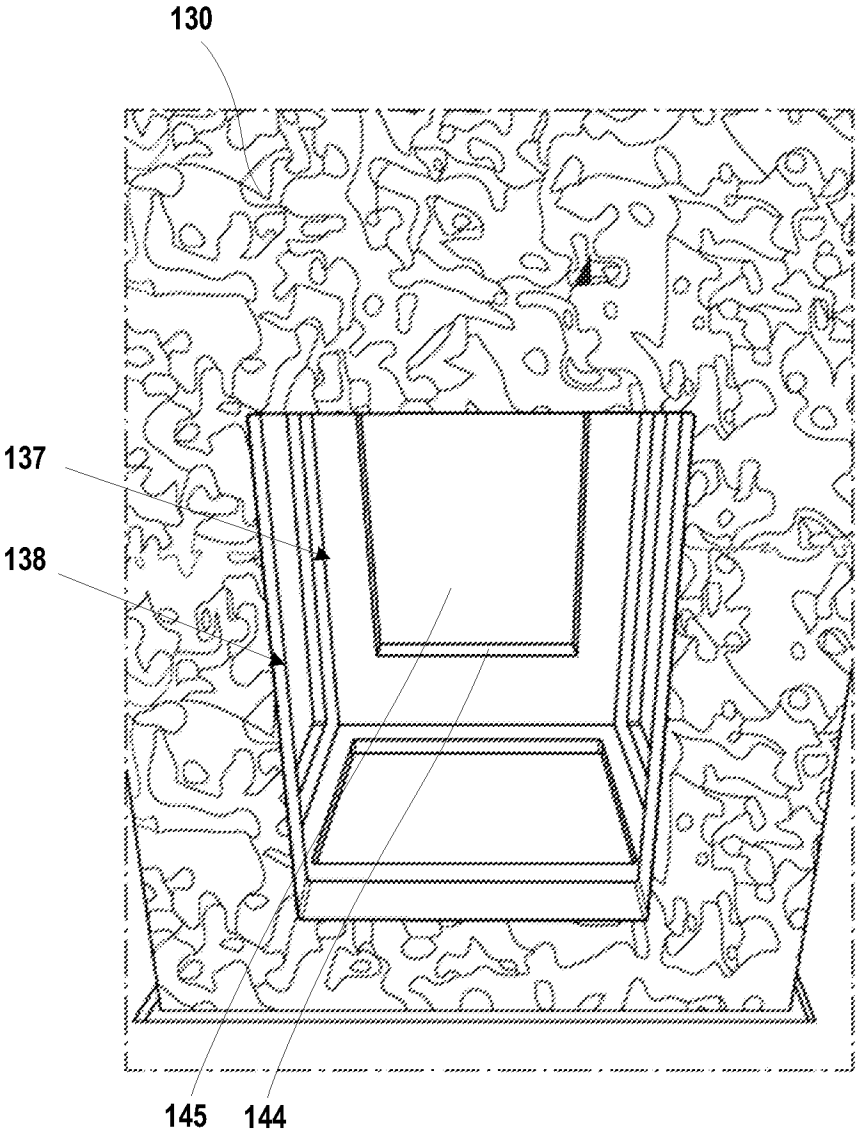
FIG. 5H is a side view through an opening in a wall into a cavity of a monolithic base according to at least one of the embodiments described herein.
Figure 5G:
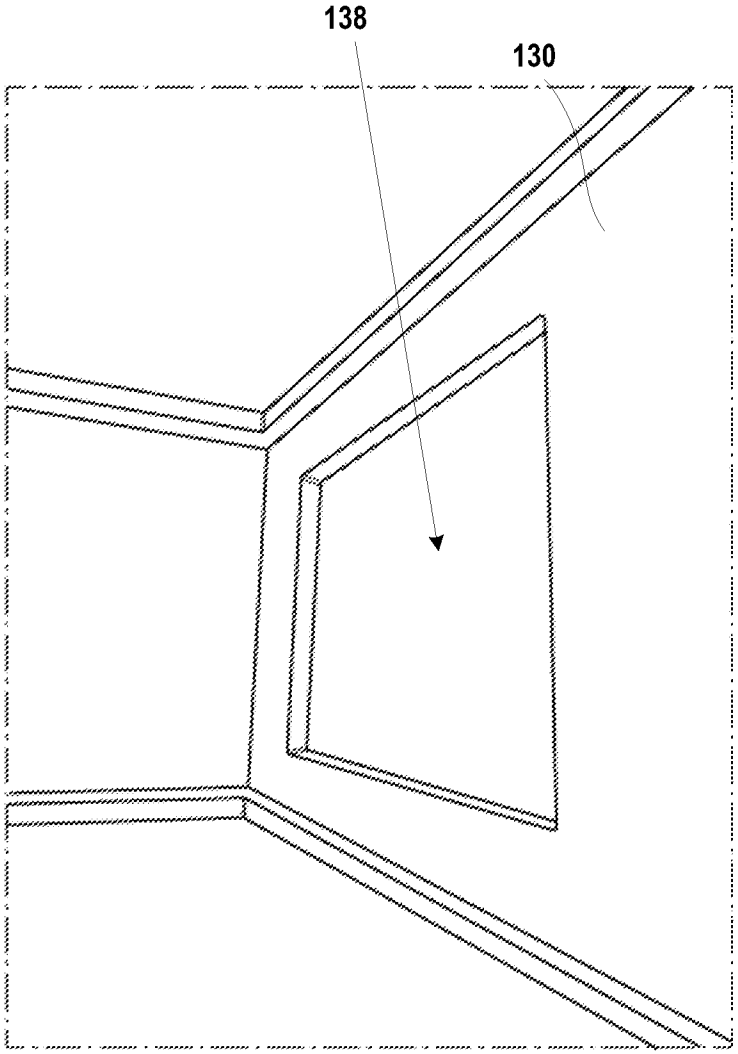
FIG. 5G is a top down view into a cavity of a monolithic base according to at least one of the embodiments described herein.

FIG. 5G is a top down view into a cavity 137 of a monolithic base 130 according to at least one of the embodiments described herein. Therein, a recessed portion 145 in a wall 130*d* of the monolithic base 130 is shown. FIG. 5H is a side view through an opening 138 in a wall 130*a* into a cavity 137 of a monolithic base 130 according to at least one of the embodiments described herein.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A modular outdoor kitchen component comprising:

a monolithic base having:

a first end configured to receive a top member;

a second end opposed to the first end; and at least four walls extending between the first end and the second end, each of the at least four walls having an interior face and an exterior face, the interior faces co-operating to define an interior cavity of the monolithic base, at least one wall of the at least four walls having a first opening therein, the first opening being configured to receive a first insertable component, the first insertable component extending inwardly from the first opening into the cavity of the monolithic base, another one of the at least four walls having a second opening, the second opening being opposed to the first opening to receive and support a portion of the first insertable component when the first insertable component is extending inwardly from the first opening into the cavity of the monolithic base.

2. The modular outdoor kitchen component of claim 1, wherein the first insertable component is a refrigerator, a cabinet, a set of one or more drawers, a basin, or a sink.

3. The modular outdoor kitchen according to claim 1, wherein the first insertable component is a storage compartment.

4. The modular outdoor kitchen component of claim 1, wherein one or more of the exterior faces of the monolithic base is configured to resemble brick, stone, stucco, tile, or wood or to otherwise have a pattern thereon.

5. The modular outdoor kitchen component of claim 1, wherein the second end of the monolithic base is configured to receive one or more wheels.

6. The modular outdoor kitchen component of claim 1, wherein the monolithic base is made of concrete.

7. The modular outdoor kitchen component of claim 1 further comprising the first insertable component, the first insertable component configured to rest on a lower edge of the first opening when the first insertable component is extending inwardly from the first opening into the cavity of the monolithic base.

8. A method of providing a modular outdoor kitchen component, the method comprising:

providing a lower support member of a form, the lower support member having a plurality of female members of coupling members extending upwardly therefrom;

positioning an outer frame on the lower support member of the form, the outer frame comprising a plurality of outer wall members removably coupled together;

positioning an inner frame on the lower support member of the form to form a cavity between an outer surface of the inner frame and an inner surface of the outer frame, the inner frame comprising a plurality of inner wall members removably coupled together, each said female member of the coupling members being positioned within the cavity between the outer surface of the inner frame and the inner surface of the outer frame;

providing a monolithic base by inserting a material into the cavity and allowing the material to harden;

removing the outer wall members of the outer frame from the monolithic base;

removing the inner wall members of the inner frame from the monolithic base; and inserting an insertable component into an opening formed in a wall of the monolithic base.

9. The method of claim 8, wherein at least one of the inner wall members of the inner frame includes a first protruding portion, the first protruding portion extending inwardly from the outer surface of the at least one inner wall member a distance equal to a width of the cavity between an outer surface of the inner frame and an inner surface of the outer frame to form the opening.

10. The method of claim 9, wherein at least one other inner wall member of the inner wall members includes a second protruding portion, the second protruding portion extending inwardly from the outer surface of the at least one other inner wall member a distance less than the width of the cavity between an outer surface of the inner frame and an inner surface of the outer frame to form a recessed portion of the monolithic base, the recessed portion being opposed to the opening.

11. The method of claim 8, wherein the lower support member includes a protruding portion sized and shaped to guide the positioning of the inner frame on the lower support member.

12. The method of claim 8 further comprising, before providing the lower support member of the form, attaching each said female member to the lower support member of the form.

13. A modular outdoor kitchen component comprising:

a monolithic base having:

a first end;

a second end opposed to the first end and configured to receive a top member; and at least four walls extending between the first end and the second end, each of the at least four walls having an interior face and an exterior face, the interior faces co-operating to define an interior cavity of the monolithic base, at least one wall of the at least four walls having a first opening therein, the first opening being configured to receive a first insertable component, the first insertable component extending inwardly from the first opening into the cavity of the monolithic base, another one of the at least four walls of the monolithic base having a recessed portion, the recessed portion being opposed to the first opening to receive and support a portion of the first insertable component when the first insertable component is extending inwardly from the first opening into the cavity of the monolithic base.

14. The modular outdoor kitchen component of claim 13, wherein the insertable component is a refrigerator, a cabinet, a set of one or more drawers, a basin, or a sink.

15. The modular outdoor kitchen component according to claim 13, wherein the insertable component is a storage compartment.

16. The modular outdoor kitchen component according to claim 13, wherein one or more of the exterior faces of the monolithic base is configured to resemble brick, stone, stucco, tile, or wood or to otherwise have a pattern thereon.

17. The modular outdoor kitchen component of claim 13, wherein the second end of the monolithic base is configured to receive one or more wheels.

18. The modular outdoor kitchen component of claim 13, wherein the monolithic base is made of concrete.

19. The modular outdoor kitchen component of claim 13 further comprising the insertable component, the insertable component configured to rest on a lower edge of the first opening when the insertable component is extending inwardly from the first opening into the cavity of the monolithic base.

20. The modular outdoor kitchen component of claim 13, wherein the recessed portion is shaped to conform to a shape of the first insertable component.

* * * * *